US012601161B2

(12) United States Patent
Hellyer et al.

(10) Patent No.: US 12,601,161 B2
(45) Date of Patent: Apr. 14, 2026

(54) FAUCET MOUNTING SYSTEM

(71) Applicant: Delta Faucet Company, Indianapolis, IN (US)

(72) Inventors: Ryan Keith Hellyer, Carmel, IN (US); David Lee, Westfield, IN (US)

(73) Assignee: Delta Faucet Company, Indianapolis, IN (US)

( * ) Notice: Subject to any disclaimer, the term of this patent is extended or adjusted under 35 U.S.C. 154(b) by 72 days.

(21) Appl. No.: 18/588,303

(22) Filed: Feb. 27, 2024

(65) Prior Publication Data

US 2024/0295100 A1 Sep. 5, 2024

Related U.S. Application Data

(60) Provisional application No. 63/449,145, filed on Mar. 1, 2023.

(51) Int. Cl.
*E03C 1/04* (2006.01)

(52) U.S. Cl.
CPC ..... *E03C 1/0402* (2013.01)

(58) Field of Classification Search
CPC .. F16B 37/0828; F16B 37/0857; F16B 37/08; E03C 1/0402
See application file for complete search history.

(56) References Cited

U.S. PATENT DOCUMENTS

| | | | | |
|---|---|---|---|---|
| 2,685,812 | A | 8/1954 | Dmitroff | |
| 3,273,443 | A | 9/1966 | Rubin | |
| 3,425,314 | A | 2/1969 | Ohlson | |
| 4,378,187 | A | 3/1983 | Fullerton | |
| 4,990,044 | A | 2/1991 | Kimak | |
| 5,427,488 | A * | 6/1995 | Fullerton | F16B 37/0857 285/35 |
| 5,518,016 | A | 5/1996 | Sharwark | |
| 6,361,260 | B1 | 3/2002 | Schirrmacher | |
| 6,974,291 | B2 * | 12/2005 | Li | F16B 37/0864 411/429 |
| 7,753,074 | B2 | 7/2010 | Rosko et al. | |
| 8,231,318 | B2 | 7/2012 | Pitsch et al. | |
| 8,439,620 | B2 | 5/2013 | Mellyn | |
| 8,764,361 | B2 | 7/2014 | Seaman et al. | |
| 9,127,706 | B2 | 9/2015 | Leibfried et al. | |
| 9,222,245 | B2 | 12/2015 | Ye et al. | |
| 9,254,528 | B2 | 2/2016 | Cain et al. | |

(Continued)

FOREIGN PATENT DOCUMENTS

| | | |
|---|---|---|
| EP | 2 138 729 | 12/2009 |

OTHER PUBLICATIONS

Snap-on Incorporated, ZipNut Technology, retrieved on May 12, 2021 from https://www.fastorq.com/products/zipnut-technolgy, 3 pages.

(Continued)

*Primary Examiner* — Erin Deery
(74) *Attorney, Agent, or Firm* — Bose McKinney & Evans LLP

(57) ABSTRACT

A faucet mounting system including a mounting shank including external threads and configured to be coupled to a mounting deck. A securement device is operably coupled to the mounting shank and includes internal threads. The internal threads of the securement device are engaged with the external threads of the mounting shank in a first mode. The internal threads of the securement device are disengaged from the external threads of the mounting shank in a second mode.

22 Claims, 18 Drawing Sheets

(56) References Cited

U.S. PATENT DOCUMENTS

| | | | | |
|---|---|---|---|---|
| 9,695,861 | B2 | 7/2017 | Steffl | |
| 11,199,217 | B2 * | 12/2021 | Zhou | F16B 37/0864 |
| 11,306,763 | B2 * | 4/2022 | Nakaya | F16B 37/0864 |
| 11,644,060 | B2 * | 5/2023 | Ma | F16B 37/0864 411/433 |
| 2005/0008446 | A1 | 1/2005 | Allen | |
| 2005/0042059 | A1 | 2/2005 | Bremer | |
| 2006/0101576 | A1 | 5/2006 | Rhodes | |
| 2012/0237312 | A1 | 9/2012 | Widule et al. | |
| 2023/0194026 | A1 | 6/2023 | Root | |

OTHER PUBLICATIONS

J.W. Winco, Inc., GN 6303.1 Stainless Steel Quick Release Knurled Nuts, with Tapped Through Bore, retrieved on May 12, 2021 from https://www.jwwinco.com/en-us/products/2.2-Tensioning-clamping-with-handles/Quick-Release-Knobs/GN-6303.1-Stainless-Steel-Quick-Release-Knurled-Nuts, 2 pages.

McMaster Carr, quick-threading nuts, retrieved on May 12, 2021 from https://www.mcmaster.com/quick-threading-nuts, 4 pages.

Wixroyd, 24502—Fast Nut—With Collar, retrieved on May 12, 2021 from https://www.wixroyd.com/en/catalog/work-holding/fixing-elements-inserts-gauges/nuts/quick-nuts/24502/g+m+c+s+a, 4 pages.

WDS Components, Quick-Action Nuts, retrieved on May 12, 2021 from https://www.wdscomponents.com/en-us/machine-hardware/nuts/quick-action-nuts/c-444, 2 pages.

Ferguson, Walraven ⅜ in. Rapidstrut Slide Nut, retrieved on May 12, 2021 from https://www.ferguson.com/product/walraven-38-in-rapidstrut-slide-nut-wsr66517109/_/R-3870956, 1 page.

Direct Industry, Mechanical Power Clamping Nut Series MCA-DB, retrieved on Oct. 20, 2023 from https://www.directindustry.com/prod/jakob-antriebstechnik-gmbh/product-13744-2426507.html, 1 page.

* cited by examiner

FAUCET MOUNTING SYSTEM

CROSS-REFERENCE TO RELATED APPLICATION

The present application claims priority to U.S. Provisional Patent Application Ser. No. 63/449,145, filed Mar. 1, 2023, the disclosure of which is expressly incorporated herein by reference.

BACKGROUND AND SUMMARY OF THE DISCLOSURE

The present invention relates generally to a faucet mounting system and, more particularly, to quick mount nuts cooperating with a mounting shank to facilitate installation of a faucet.

Faucet installation systems typically include a mounting shank that extends through a mounting deck, and a mounting nut that couples to the mounting shank below the mounting deck to secure the faucet thereto. A conventional mounting nut threadably couples with the mounting shank. As a result, the mounting nut may be disposed at various positions along the mounting shank to accommodate mounting decks having a variety of thicknesses. However, it can be tedious and time consuming to rotate the mounting nut from a lower end to an upper end of the mounting shank to couple the faucet to the mounting deck.

The faucet mounting system of the present disclosure simplifies the installation process of a conventional nut. Rather than having to rotate a conventional nut along the length of the externally threaded mounting shank, illustrative securement devices of the present disclosure can be slidably moved upwardly along the length of the mounting shank and then secured once at the desired position. As such, the illustrative securement devices save considerable time in the installation process, particularly when the externally threaded mounting shank is long and the thread pitch is fine.

An illustrative securement device of the present disclosure is configured to slide only in a first axial direction (e.g., upwardly) on the externally threaded mounting shank (i.e., unidirectional sliding). The securement device is unscrewed similar to a conventional nut to move in a second axial direction (e.g., downwardly) opposite the first axial direction, thereby preventing unwanted loosening. The illustrative securement device achieves unidirectional sliding on the externally threaded mounting shank via the use of a flexible, internally threaded insert. A first conical feature is configured to expand the flexible, internally threaded insert over the externally threaded mounting shank when the securement device is slidably moved in the first axial direction. A second conical feature is configured to compress the flexible, internally threaded insert onto the externally threaded mounting shank when the illustrative securement device is forced in the opposite second direction.

A further illustrative securement device includes a pivotable lever movable from an unlocked position to a locked position for constricting a split ring into frictional engagement with an externally threaded mounting shank.

Another illustrative securement device includes a cam movable from an unlocked position to a locked position for engaging a locking block supporting internal threads into frictional engagement with an externally threaded mounting shank.

According to an illustrative embodiment of the present disclosure, a faucet mounting system includes a mounting shank including external threads and configured to be coupled to a mounting deck. A securement device includes an upper housing having an inner surface, and an insert received within the upper housing. The insert includes a body, an inner surface defining a passageway extending between a lower end and an upper end, an outer surface, and internal threads extending into the passageway. At least one of the inner surface of the upper housing and the outer surface of the insert is tapered. Engagement of the inner surface of the upper housing and the outer surface of flexible insert forces the internal threads inwardly toward the external threads of the mounting shank. A lower housing includes an engagement surface received within the lower end of the passageway of the insert. Engagement of the engagement surface of the lower housing and the inner surface of the insert forces the internal threads outwardly away from the external threads of the mounting shank.

According to another illustrative embodiment of the present disclosure, a mounting nut includes an upper housing having an inner surface, and an insert received within the upper housing. The insert includes a body, an inner surface defining a passageway extending between a lower end and an upper end, an outer surface, and internal threads extending into the passageway. At least one of the inner surface of the upper housing and the outer surface of the insert is frusto-conical. Engagement of the inner surface of the upper housing and the outer surface of the insert forces the internal threads inwardly. A lower housing includes a frusto-conical surface received within the lower end of the passageway of the body of the insert. Engagement of the frusto-conical surface of the lower housing and the inner surface of the insert forces the internal threads outwardly.

According to a further illustrative embodiment of the present disclosure, a faucet mounting system includes a mounting shank having external threads, and a securement device. The securement device includes a body having first internal threads, and a clamping member pivotably supported by the body. The clamping member includes second internal threads facing the first internal threads. The securement device further includes a lever pivotably supported by the body, wherein pivoting movement of the lever pivots the clamping member between an inward position and an outward position.

According to another illustrative embodiment of the present disclosure, a faucet mounting system includes a mounting shank having internal threads, and a securement device. The securement device includes a body having first internal threads, and a locking block having a second internal threads facing the first internal threads. A cam is pivotably supported by the body and includes an arcuate surface to engage the locking block to move the second internal threads inwardly toward the first internal threads due to pivoting of the cam.

Additional features and advantages of the present invention will become apparent of those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures, in which.

DETAILED DESCRIPTION OF THE DRAWINGS

The embodiments of the invention described herein are not intended to be exhaustive or to limit the invention to the precise form disclosed. Rather, the embodiments selected for description have been chosen to enable one skilled in the art to practice the invention.

Figure 1:
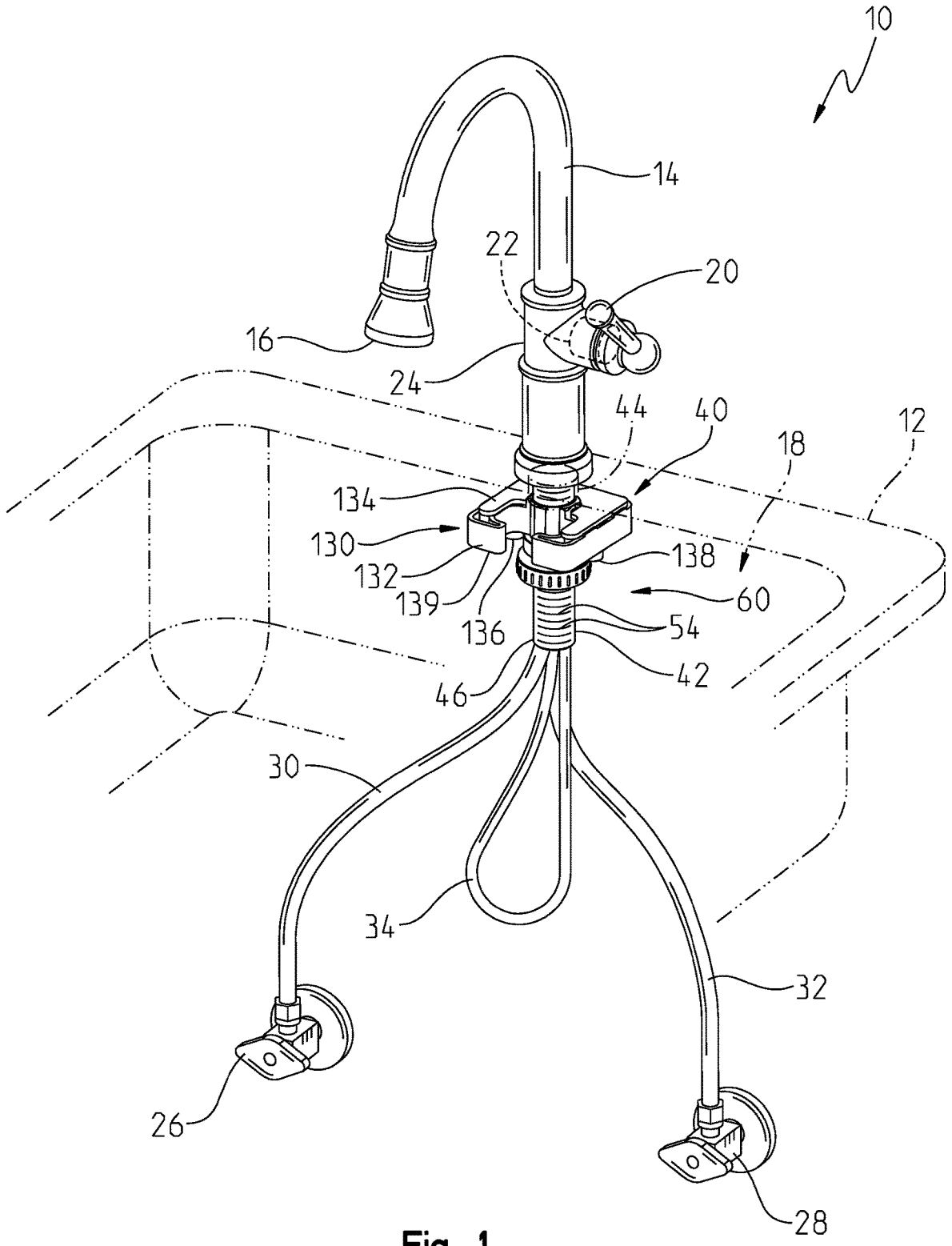
FIG. 1 is a perspective view of an illustrative faucet including a faucet mounting system according to an illustrative embodiment of the present disclosure.
Figure 2:
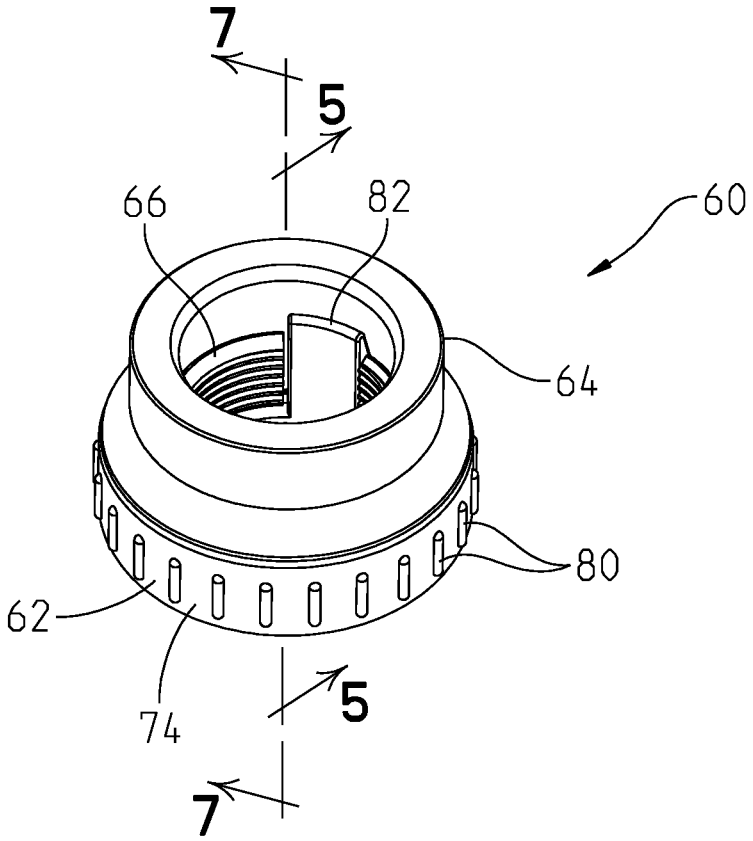
FIG. 2 is a perspective view of the illustrative faucet mounting system of FIG. 1.
Figure 3:
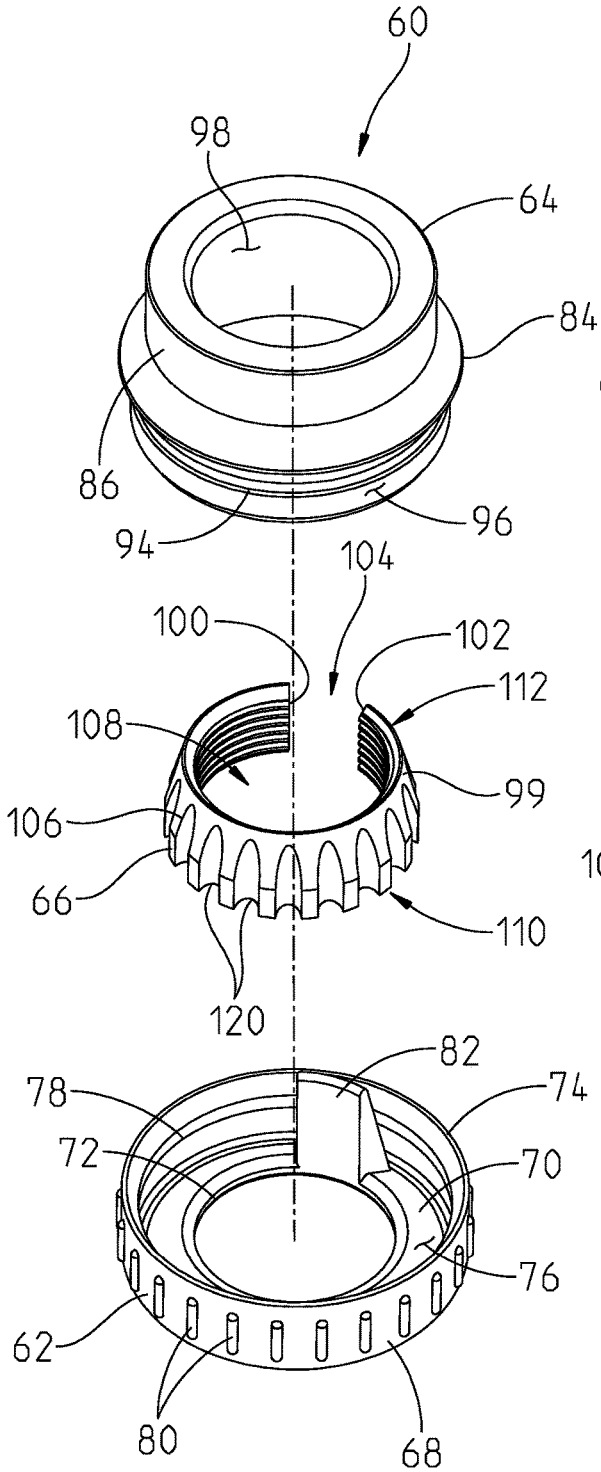
FIG. 3 is an upper exploded perspective view of the faucet mounting system of FIG. 2.
Figure 4:
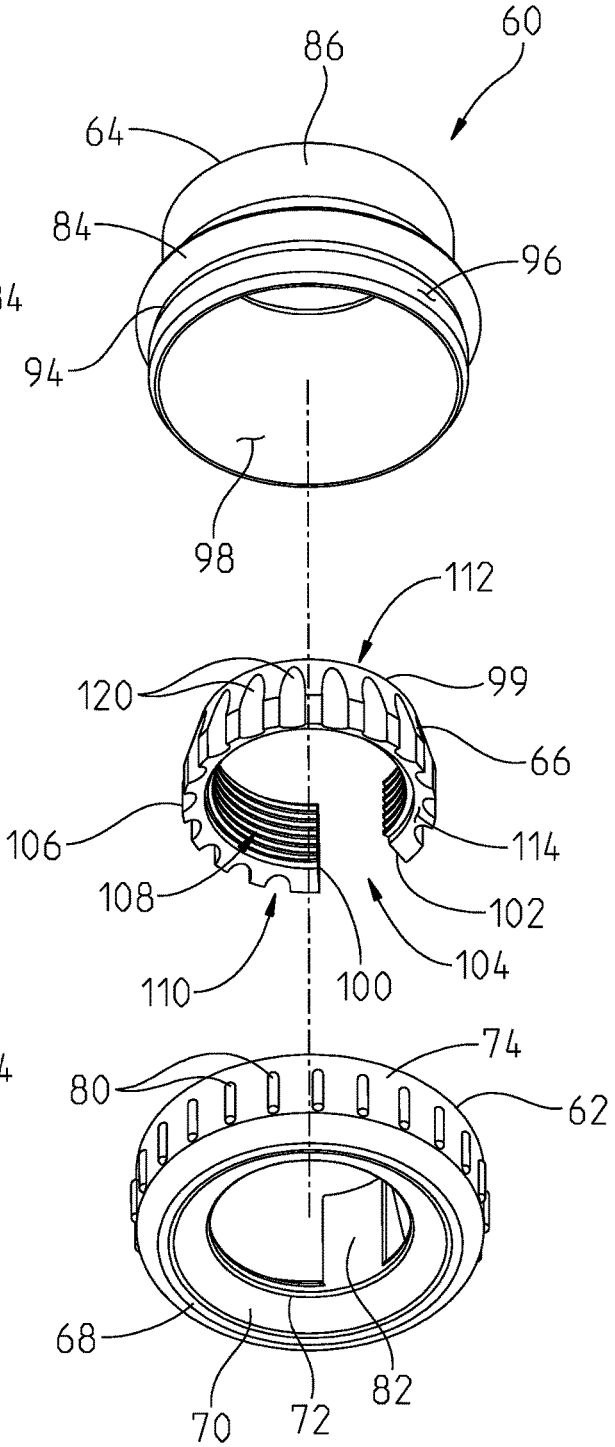
FIG. 4 is a lower exploded perspective view of the faucet mounting system of FIG. 2.
Figure 5:
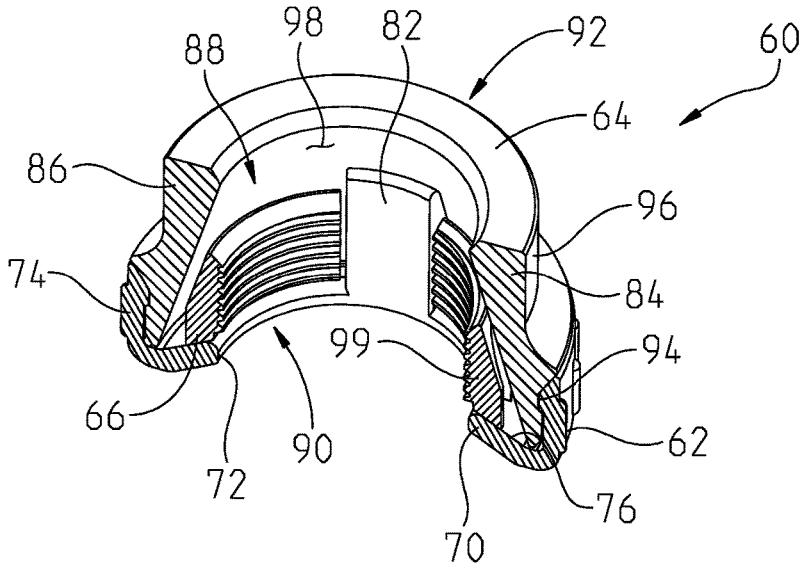
FIG. 5 is a perspective view, in cross-section taken along line 5-5, of the faucet mounting system of FIG. 2.

Referring initially to FIG. 1, an illustrative faucet 10 is shown coupled to a mounting deck 12, such as a sink deck. The faucet 10 illustratively includes a delivery spout 14 defining a water outlet 16 for discharging water into a sink basin 18 surrounded by the mounting deck 12. Illustratively, a faucet handle 20 is operably coupled to a mixing valve assembly 22 supported by a hub 24 of the delivery spout 14. Hot water is supplied from a hot water source 26 (illustratively, a conventional hot water stop) to the mixing valve assembly 22, while cold water is supplied from a cold water source 28 (illustratively, a conventional cold water stop) to the mixing valve assembly 22.

Illustratively, hot water and cold water inlet conduits 30 and 32 fluidly couple the hot and cold water sources 26 and 28 to the mixing valve assembly 22. The hot water and cold water inlet conduits 30 and 32 are illustratively formed of a flexible tubular material, such as a polymer (e.g., a cross-link polyethylene (PEX)). As is known, the mixing valve assembly 22 controls water flow to the water outlet 16 of the delivery spout 14. More particularly, the delivery spout 14 is fluidly coupled to an outlet of the mixing valve assembly 22 via an outlet conduit 34. The outlet conduit 34 is illustratively formed of a flexible tubular material, such as a polymer (e.g., a cross-link polyethylene (PEX)). In one illustrative embodiment, the mixing valve assembly 22 may be of the type detailed in U.S. Pat. No. 7,753,074 to Rosko et al., the disclosure of which is expressly incorporated herein by reference.

Figure 8:
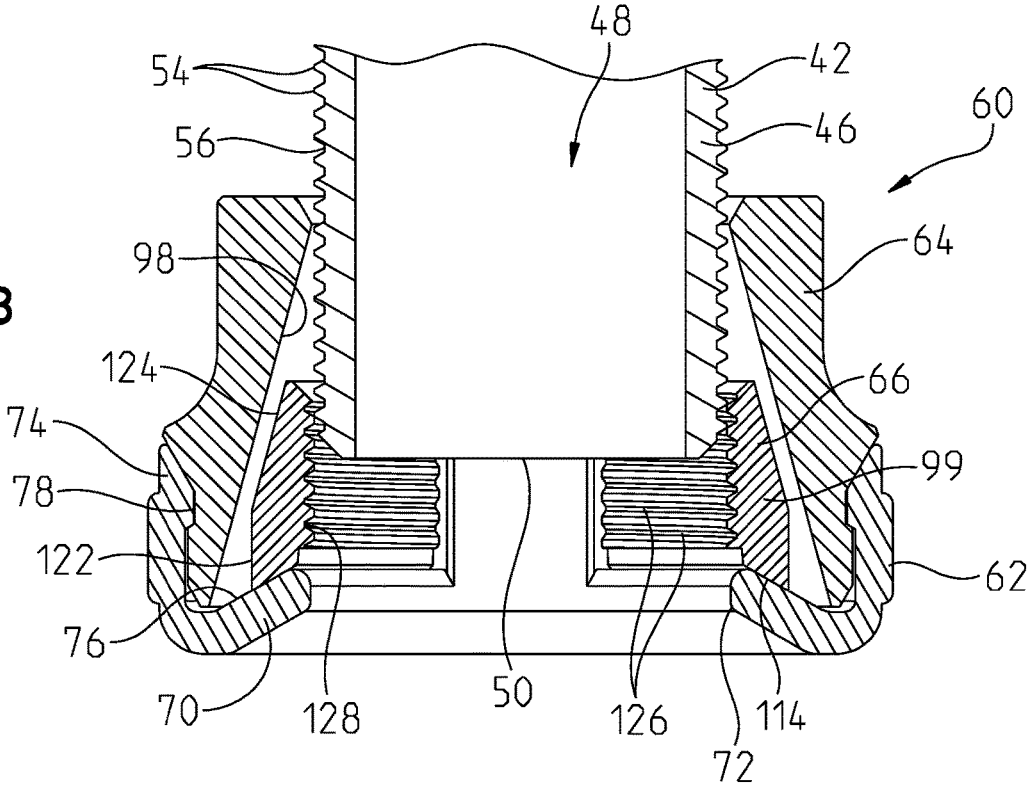
FIG. 8 is a cross-sectional view similar to FIG. 6, showing the threaded insert of the mounting system in an expanded state.
Figure 9:
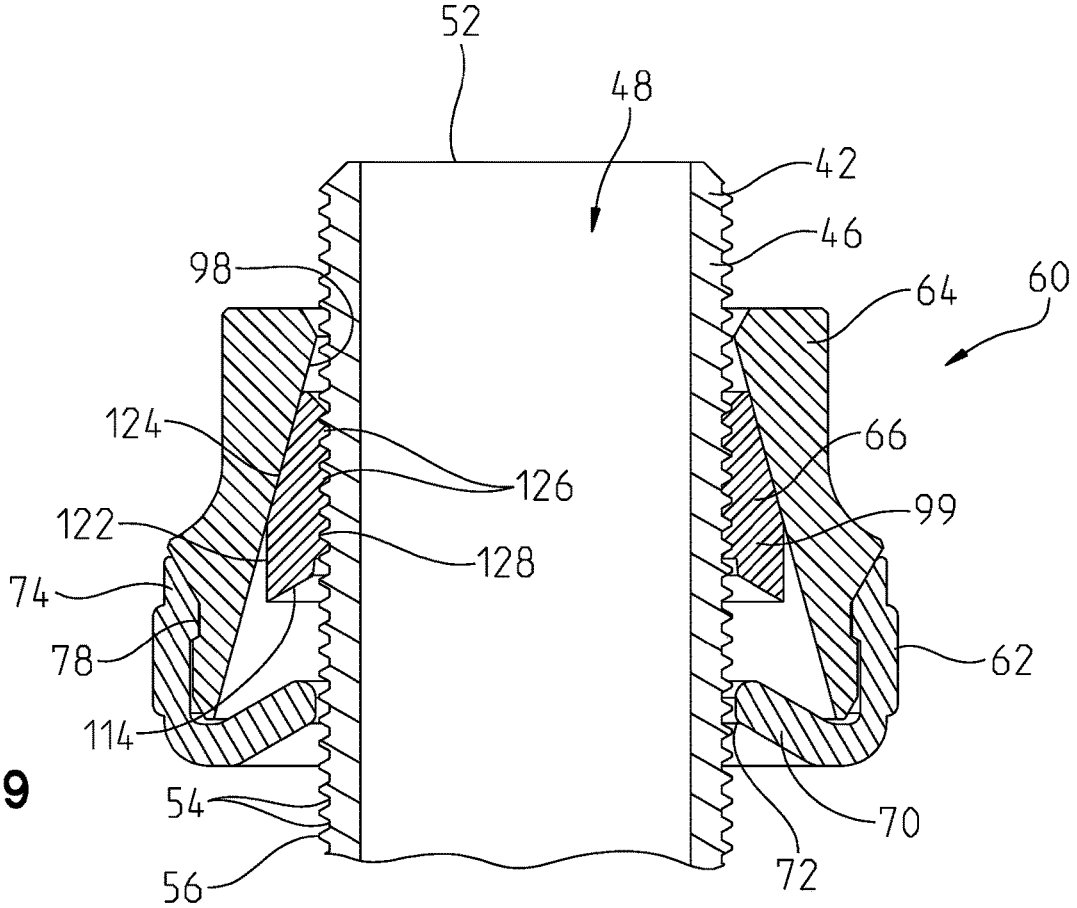
FIG. 9 is a cross-sectional view similar to FIG. 6, showing the threaded insert of the faucet mounting system in a contracted state.
Figure 10:
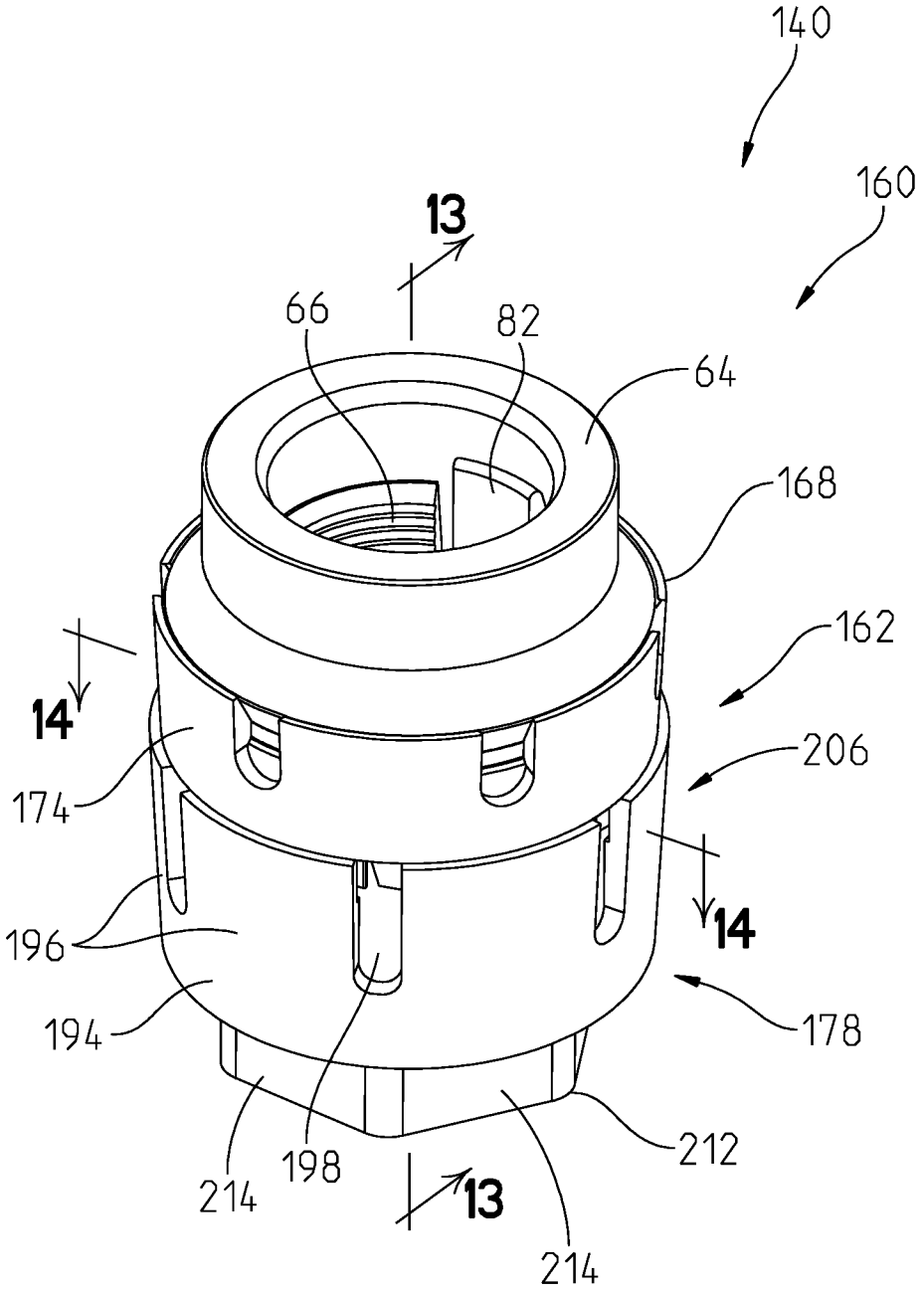
FIG. 10 is a perspective view of a further illustrative faucet mounting system of the present disclosure.
Figure 11:
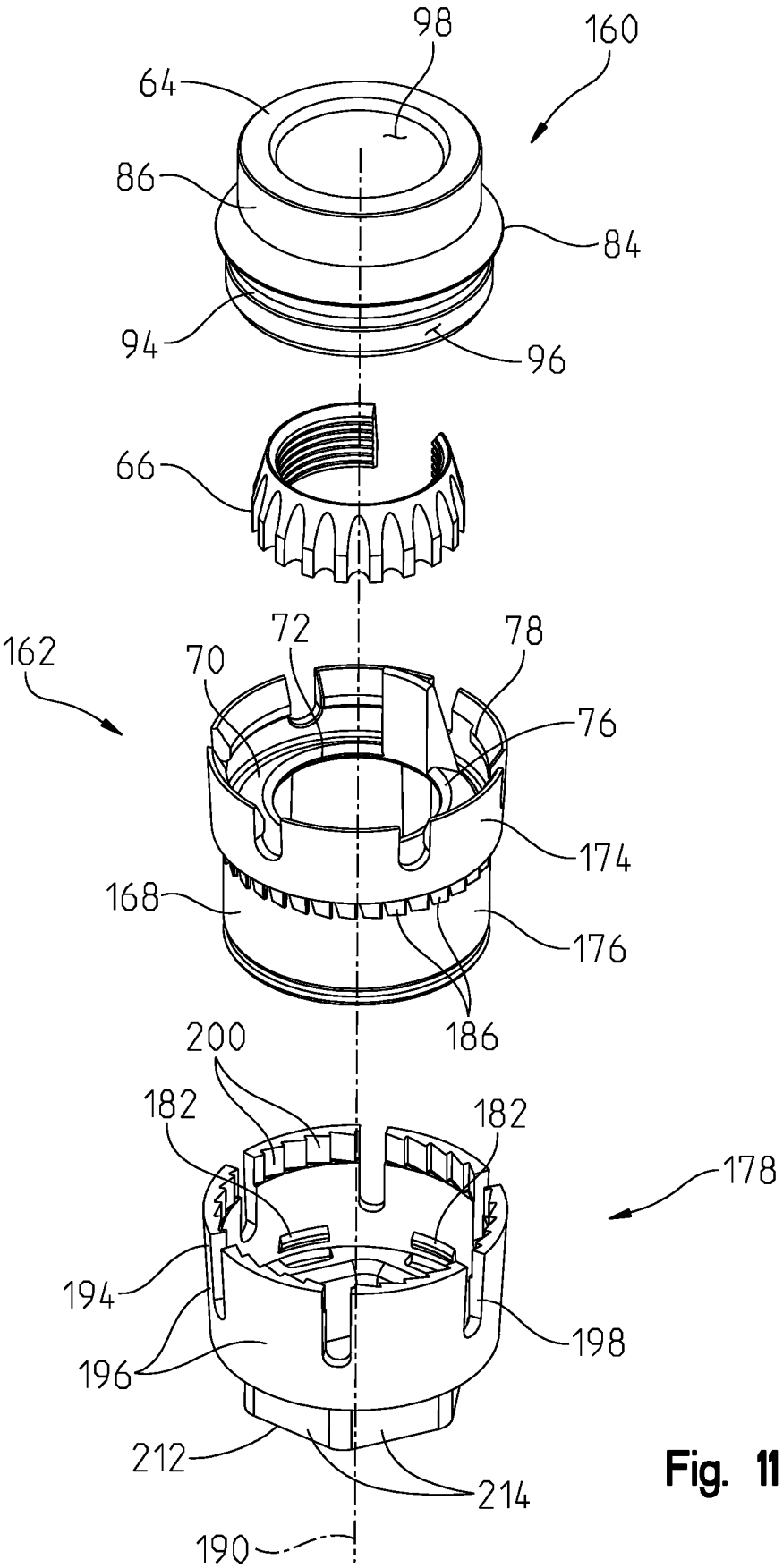
FIG. 11 is an upper exploded perspective view of the faucet mounting system of FIG. 10.
Figure 12:
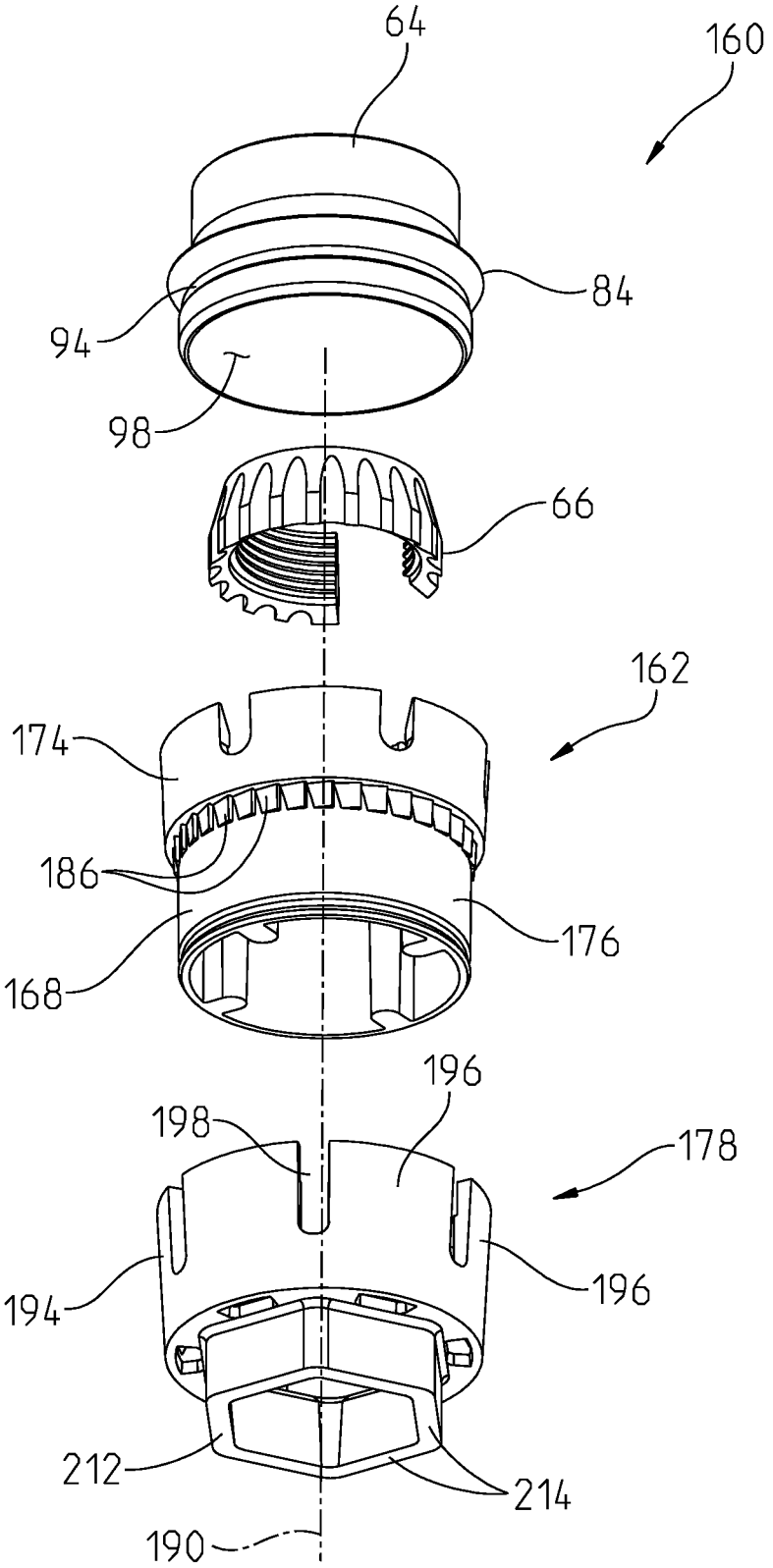
FIG. 12 is a lower exploded perspective view of the faucet mounting system of FIG. 10.
Figure 13:
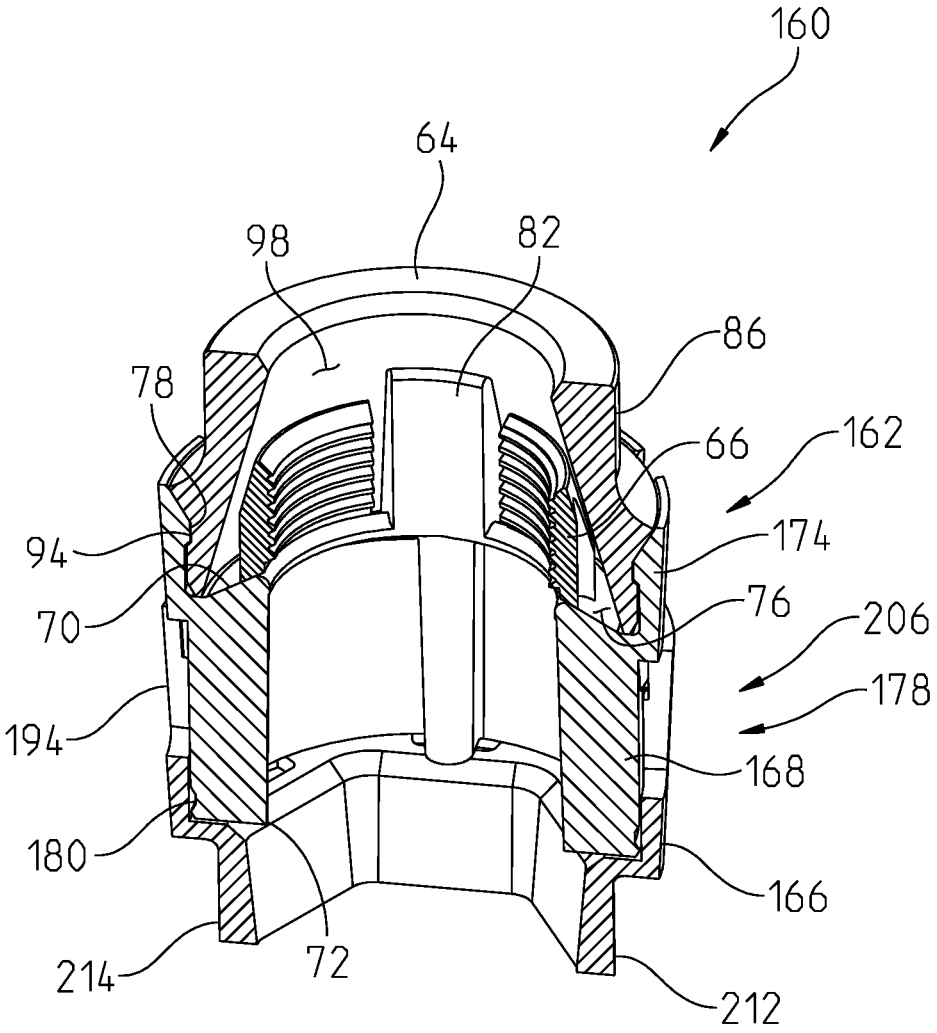
FIG. 13 is a perspective view, in cross-section taken along line 13-13, of the faucet mounting system of FIG. 10.
Figure 14:
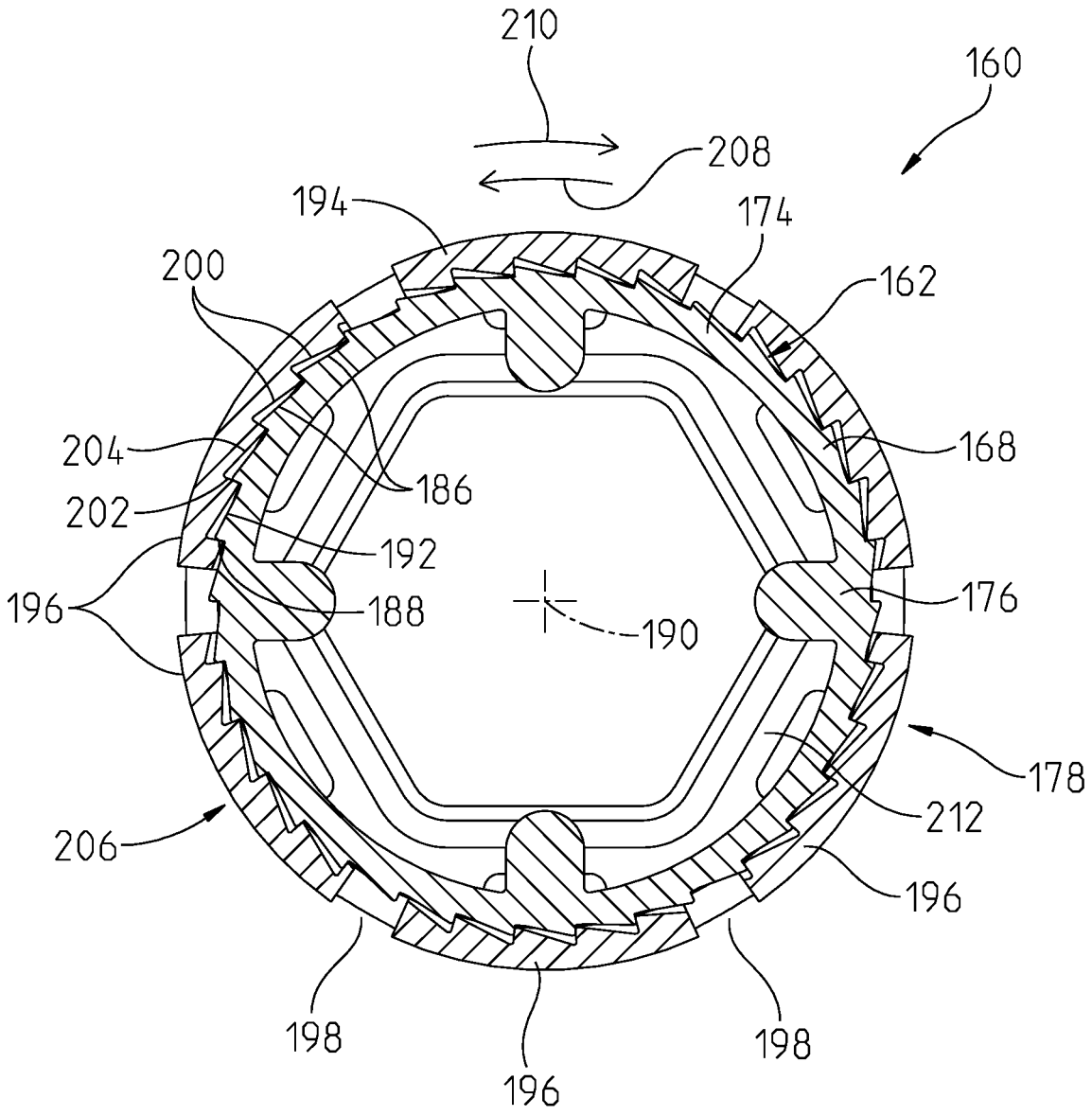
FIG. 14 is a cross-sectional view of the faucet mounting system taken along line 14-14 of FIG. 10.
Figure 15:
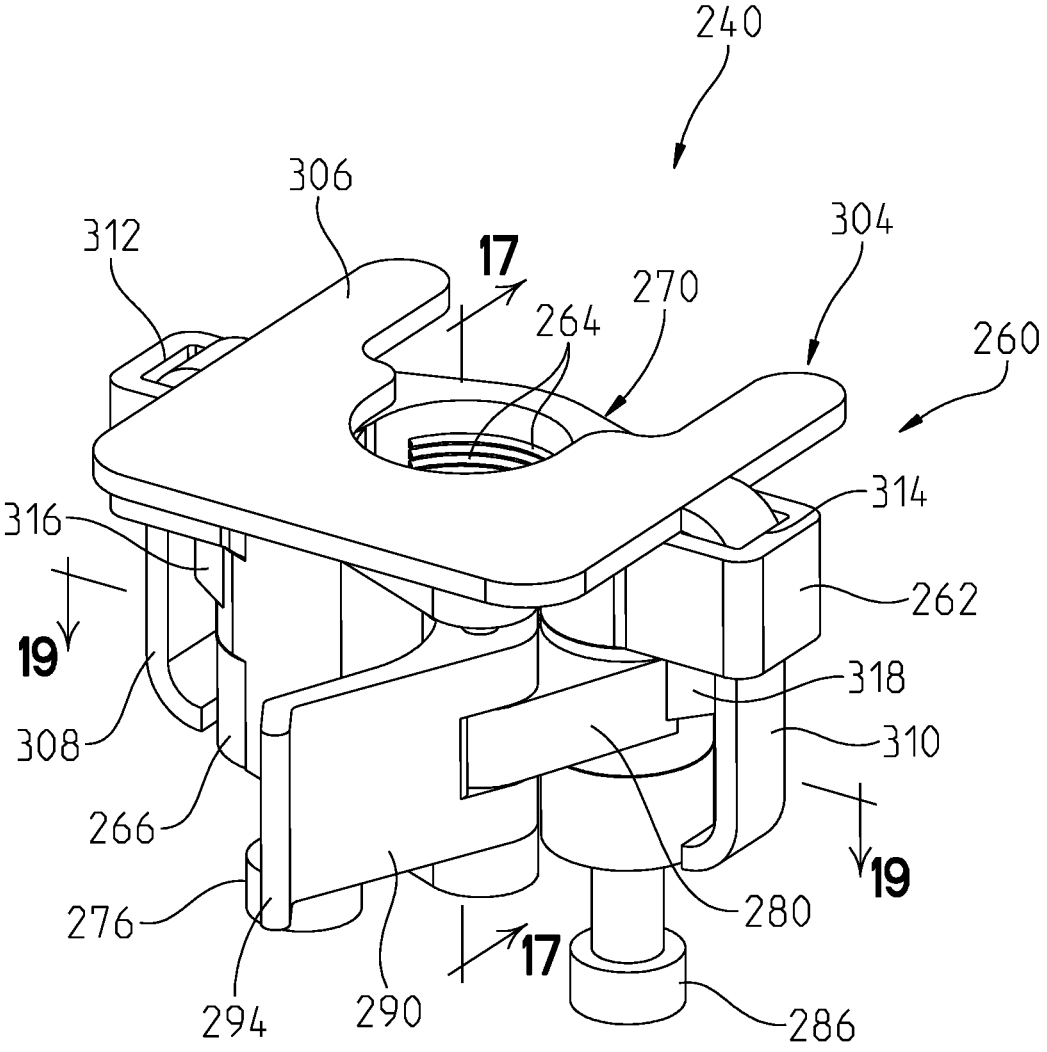
FIG. 15 is a perspective view of a further illustrative faucet mounting system of the present disclosure.

The delivery spout 14 is coupled to the mounting deck 12 via an illustrative mounting system 40. More particularly, a conventional mounting shank 42 extends through an opening 44 in the mounting deck 12 and is operably coupled to the delivery spout 14. The mounting shank 42 illustratively includes a cylindrical side wall 46 defining a passageway 48 extending between a lower end 50 and an upper end 52 (FIGS. 8 and 9). As shown in FIG. 1, the conduits 30, 32, 34 are illustratively received within the passageway 48, and the hub 24 is secured to the upper end 46 of the mounting shank 42. External or male threads 54 are illustratively formed on an outer surface 56 of the mounting shank 42. The mounting shank 42 may be formed of a metal, such as brass.

With reference to FIGS. 2-7, an illustrative securement device 60 cooperates with the mounting shank 42 to secure the faucet 10 to the mounting deck 12. The securement device 60 illustratively is a quick-mount slide nut including a lower housing 62 coupled to an upper housing 64 and cooperating with a threaded insert 66. As further detailed herein, the illustrative securement device 60 is configured to operate in three different modes or states, including a default or free mode (FIG. 6), an unlocked or expanded mode (FIG. 8), and a locked or contracted mode (FIG. 9). In the default mode, the securement device 60 operates as a conventional threaded nut. In the unlocked mode, the securement device 60 is configured to slide axially in a first direction (e.g., upwardly) along the mounting shank 42. In the locked mode, the securement device 60 is in locking engagement with the mounting shank 42.

The lower housing 62 illustratively includes a body 68 having a base or lower wall 70 defining a center opening 72. The lower housing 62 may be formed of a material such as a polymer, having desired strength and lubricity (coefficient of friction) to facilitate sliding movement relative to the threaded insert 66. A peripheral side wall 74 extends upwardly from the lower wall 70 in radial spaced relation outwardly from the center opening 72. The lower wall 70 illustratively includes an upwardly facing engagement surface 76. The engagement surface 76 is illustratively tapered. More particularly, the tapered surface 76 is illustratively a frusto-conical surface extending radially inwardly and axially upwardly from the side wall 74 toward the center opening 72. A radially inwardly extending protrusion 78, such as an annular ring, is supported by the side wall 74. A plurality of radially outwardly extending, circumferentially spaced ribs 80 may be supported by the side wall 74 to facilitate gripping by a user. A protrusion 82 illustratively extends axially upwardly from the lower wall 70. The taper of the engagement surface 76 may extend upwardly along the protrusion 82.

The upper housing 64 is coupled to the lower housing 62 and extends axially upwardly therefrom. The upper housing 64 may be formed of a material, illustratively a metal (e.g., aluminum), having desired strength and lubricity (coefficient of friction) to facilitate sliding movement relative to the threaded insert 66. The upper housing 64 includes a body 84 having a side wall 86 defining a passageway 88 extending between a lower end 90 and an upper end 92. An annular groove 94 is illustratively formed within an outer surface 96 of the side wall 86 and receives the protrusion 78 of the lower housing 62 to provide coupling therebetween. The side wall 86 illustratively includes a tapered inner surface 98 such as a frusto-conical surface extending radially inwardly and axially upwardly from the lower end 90 toward the upper end 92.

The threaded insert 66 is received within the passageway 88 of the upper housing 64. The threaded insert 66 may be formed of a flexible material, illustratively a polymer, having desired flexibility, strength, lubricity (coefficient of friction) and creep performance under load. The threaded insert 66 illustratively includes an annular body 99 extending circumferentially between opposing first and second ends 100 and 102. A split or gap 104 is defined between the first and second ends 100 and 102. The threaded insert 66 includes a side wall 106 defining a passageway 108 extending between a lower end 110 and an upper end 112. A tapered surface 114 is illustratively defined at the lower end 110 of the side wall 106. Illustratively, the tapered surface 114 is a downwardly facing frusto-conical surface extending radially inwardly and axially upwardly from an outer surface 118 of the side wall 106. The frusto-conical surface 76 of the lower housing 62 is configured to cooperate with the frusto-conical surface 114 of the threaded insert 66. As an alternative embodiment to cooperation between the tapered surface 76 of the lower housing 62 and the tapered surface 114 of the insert 66, buttress threads may be substituted therefor.

Figure 6:
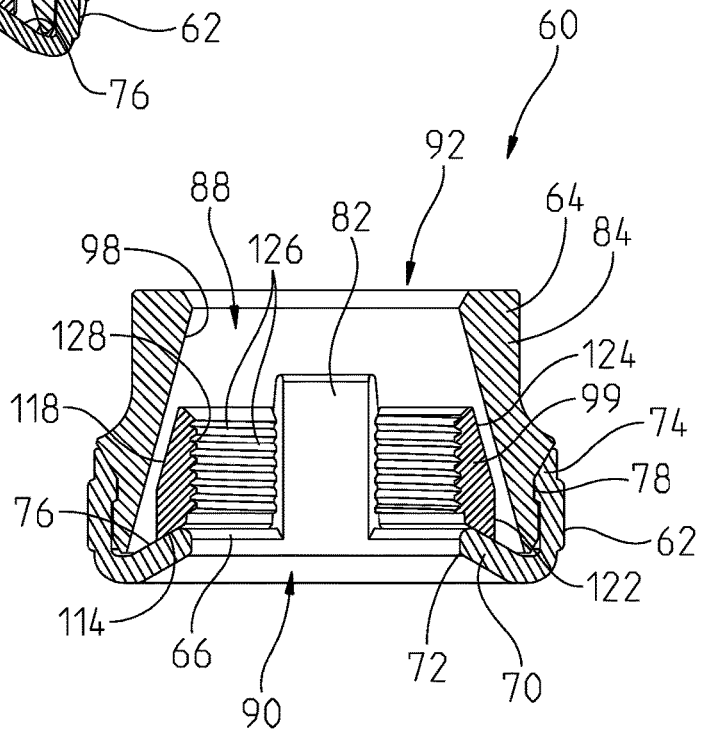
FIG. 6 is a cross-sectional view of the faucet mounting system taken along line 5-5 of FIG. 2, showing the threaded insert in a default state.
Figure 7:
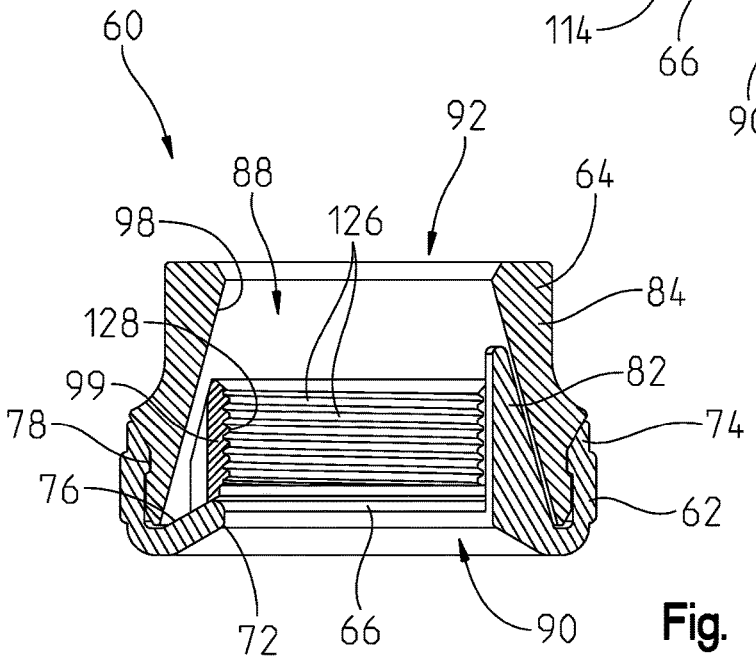
FIG. 7 is a cross-sectional view of the faucet mounting system taken along line 7-7 of FIG. 1, showing the threaded insert in the default state.

A plurality of circumferentially spaced recesses 120 are formed within the outer surface 118 of the side wall 106 to reduce material thickness and help facilitate flexibility of the threaded insert 66. With reference to FIG. 6, the outer surface 118 illustratively includes a lower cylindrical surface 122 and an upper tapered surface 124. The upper tapered surface 124 is illustratively a frusto-conical surface extending radially inwardly and axially upwardly from the lower cylindrical surface 122. Internal or female threads 126 are formed within an inner surface 128 of the side wall 106. The frusto-conical surface 124 of the insert 66 is configured to cooperate with the frusto-conical surface 98 of the upper housing 64. While the illustrative embodiment securement device 60 includes tapered surface 124 of the insert 66 and tapered insert 98 of the upper housing 64, it should be appreciated that only one or both of the surfaces 124 and 98 may be tapered.

In certain illustrative embodiments, a mounting bracket assembly 130 is slidably supported on the mounting shank 42 intermediate the securement device 60 and the mounting deck 12 (FIG. 1). The mounting bracket assembly 130 includes a body 132 movably supporting a bracket plate 134. A pair of jack screws 136 and 138 may be threadably supported within the body 132 for vertically moving the bracket plate 134.

In operation, the illustrative mounting system 40 operates in three different modes or states including the unlocked or expanded mode wherein the securement device 60 is configured to slide axially in a first direction (e.g., upwardly) on the mounting shank 42 (FIG. 8), the locked or contracted mode wherein the securement device 60 is forced axially in the opposite second direction (e.g., downwardly) on the mounting shank 42 (FIG. 9), and the default or free mode when the securement device 60 is under no axial force (FIG. 6). When the securement device 60 is being pushed in the first direction along the mounting shank 42, the flexible female threaded insert 66 is pushed into contact with the expanding frusto-conical surface 76 on the lower housing 62 by the mounting shank 42. This causes the flexible, female threaded insert 66 to expand in diameter, thereby allowing it to slip over each thread 54 on the mounting shank 42 sequentially. Thus, the securement device 60 may slide axially over the length of the mounting shank 42 in one smooth movement.

In the locked or contracted mode, the securement device 60 is pushed axially in the opposite second direction along the mounting shank 42, such as may be caused by tightening the securement device 60 against a solid surface, such as the mounting deck 12. In such a mode, the flexible, female threaded insert 66 is pushed into contact with the compressing frusto-conical surface 98 on the upper housing 64 by the mounting shank 42. This causes the flexible, female threaded insert 66 to contract in diameter and hold fast the mounting shank 42, thereby locking the securement device 60 in place. In certain illustrative embodiments, the jack screws 136 and 138 are rotated within the body 132 to force the mounting plate 134 upwardly into contact with the lower surface of the mounting deck 12.

In the default or free mode, when there is no axial force on the securement device 60, the securement device 60 is free to rotate as a conventional nut in either direction. The protrusion 82 on the lower housing 62 is received within, and cooperates with, the split 104 in the flexible female threaded insert 66, thereby allowing the transfer of torque from a user applied to the lower housing 62 to the flexible female threaded insert 66. For example, a user may simply rotate the securement device 60 in a counter-clockwise direction thereby unthreading the securement device 60 as a conventional nut downwardly along the length of the mounting shank 42 upwardly relative to the body 132. The securement device 60 illustratively engages a lower surface 139 of the body 132.

With reference now to FIGS. 10-14, a further illustrative embodiment mounting system 140 is shown as including a securement device 160. In the following description and related drawing figures, similar components of the mounting system 40 and the mounting system 140 are identified with like reference numbers.

The illustrative securement device 160 includes a lower housing 162 coupled to upper housing 64 and cooperating with flexible threaded insert 66. The lower housing 162 illustratively includes a body 168 having base or wall 70 defining center opening 72. An upper peripheral side wall 174 extends upwardly from the wall 70 in radial spaced relation outwardly from the center opening 72. The wall 70 includes upwardly facing tapered surface 76. Radially inwardly extending protrusion 78 (e.g., an annular ring) is supported by the side wall 174 and received within annular groove 94 of the upper housing 64.

The lower housing 162 further includes a lower side wall 176 operably coupled to a torque limiting ring 178. More particularly, the lower housing 162 includes an annular groove 180 receiving circumferentially spaced tabs 182 of the torque limiting ring 178, thereby coupling together the lower housing 162 and the torque limiting ring 178. The lower side wall 176 of the lower housing 162 includes a plurality of inclined uni-directional or ratchet teeth 186 extending outwardly therefrom. Each ratchet tooth 186 illustratively includes a first or locking surface 188 extending substantially radially outwardly from a center axis 190 of the securement device 160, and a second or limiting surface 192 extending substantially tangentially relative to the side wall 184.

The torque limiting ring 178 includes an upper side wall 194 defined by a plurality of circumferentially spaced apart wall sections 196 with interspaced gaps 198 to provide for flexibility of the side wall 194. The upper side wall 194 of the torque limiting ring 178 includes a plurality of inclined uni-directional or ratchet teeth 200 extending inwardly therefrom. Each ratchet tooth 200 illustratively includes a first or locking surface 202 extending substantially radially outward from a center axis 190 of the securement device 160, and a second or limiting surface 204 extending substantially tangential relative to the side wall 194.

A torque limiter 206 is defined by engagement between the ratchet teeth 186 and 200. When torque is applied to the torque limiting ring 178 in a first direction (e.g., counter-clockwise as shown by arrow 208 in FIG. 14), the torque limiting ring 178 and the teeth 200 will tend to move slightly on the corresponding teeth 186 of the lower housing 162 until sufficient friction has been developed between limiting surfaces 204 and 192, respectively. The torque limiting ring 178 will then rotate the lower housing 162, thereby rotating the upper housing 64. This will continue until the upper housing 64 abuts a mounting surface (illustratively defined by a lower surface 139 of the mounting bracket assembly 130 (FIG. 1)). At this stage, the resistance provided by the securement device 160 to rotation will increase sharply until it reaches a point at which it is equal to the driving force transmitted between the engaged teeth 200 and 186. The limiting surfaces 204 and 192 of the teeth 200 and 186 will begin to slip to prevent any increase in applied torque above a predetermined value (e.g., 25 lb-in).

When torque is applied to the torque limiting ring 178 in a second direction (e.g., clockwise as shown by arrow 210 in FIG. 14), the locking surface 202 of the teeth 200 and the locking surface 188 of the teeth 186 will engage such that the torque limiting ring 178 will rotate the lower housing 162, thereby rotating the upper housing 64. In other words, no torque limiting function is provided in the second direction 210 such that the securement device 160 rotates similar to a conventional nut.

A lower tool engagement portion 212 extends downwardly relative to the upper side wall 194. The lower tool engagement portion 212 illustratively includes a plurality of flats 214 (e.g., a hex drive feature) configured to be engaged by a tool, such as a wrench (not shown), for manipulation by a user to facilitate rotation of the torque limiting ring 178.

With reference now to FIGS. 15-21, a further illustrative embodiment mounting system 240 is shown as including a securement device 260, illustratively a quick mount nut. In the following description and related drawing figures, similar components of the mounting system 40 and the mounting system 240 are identified with like reference numbers.

The illustrative securement device 260 includes a body 262 having first internal threads 264, and a clamping member 266 pivotably supported by the body 262. The clamping member 266 includes second internal threads 268 facing inwardly toward the first internal threads 264 of the body 262. The body 262 and the clamping member 266 together illustratively define a split ring 270 including the opposing internal threads 264 and 268, respectively.

Figure 16:
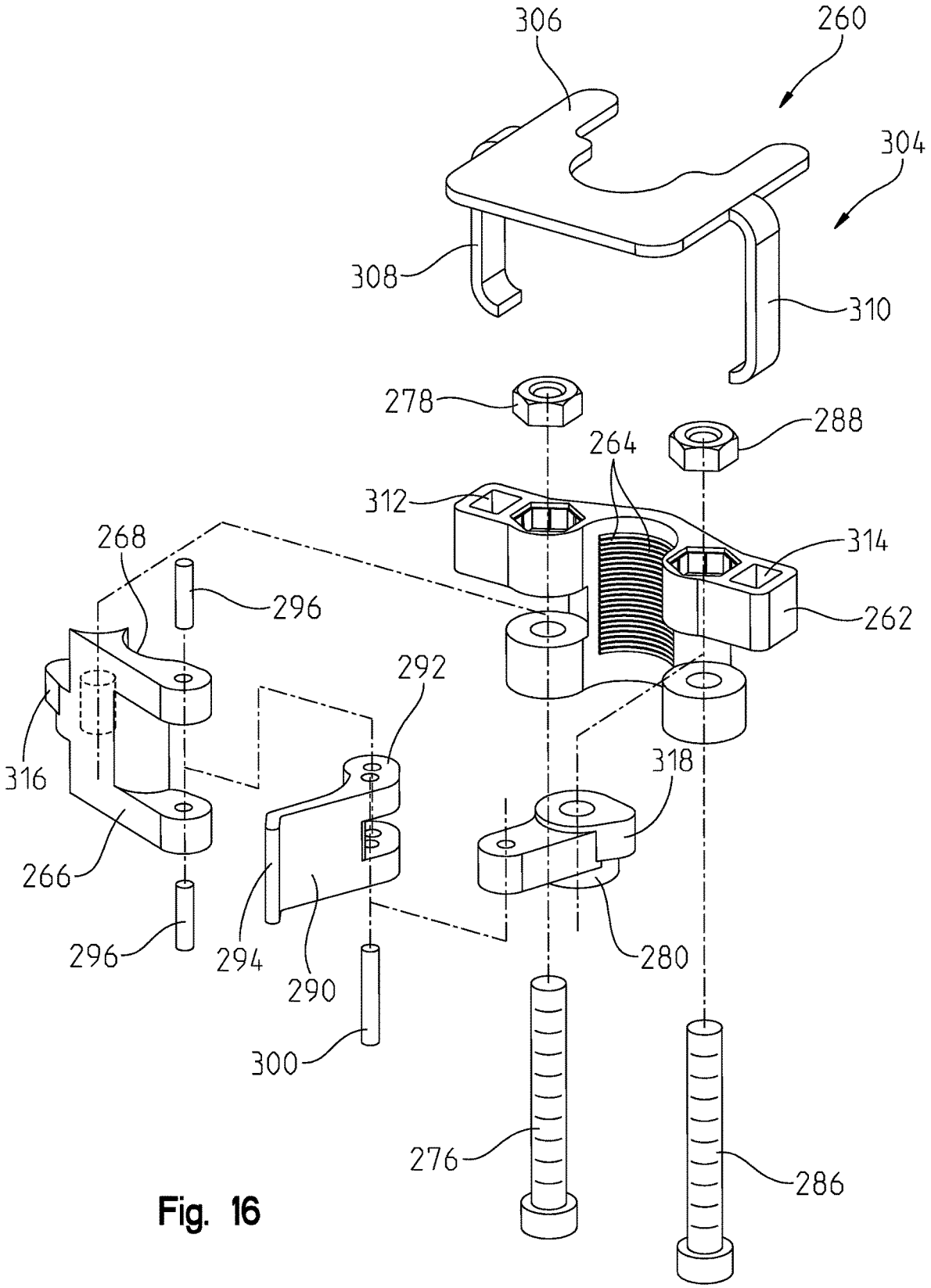
FIG. 16 is an exploded perspective view of the faucet mounting system of FIG. 15.
Figure 17:
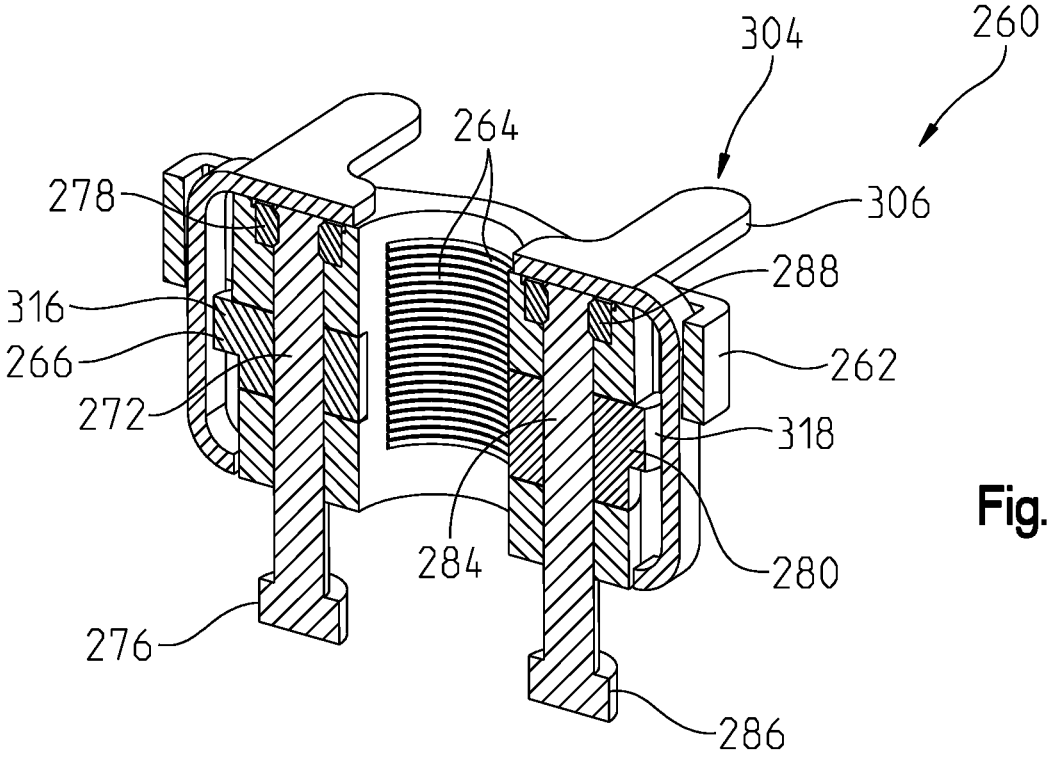
FIG. 17 is a perspective view, in cross-section taken along line 17-17, of the faucet mounting system of FIG. 15 with the bracket shown in a lowered position.
Figure 18:
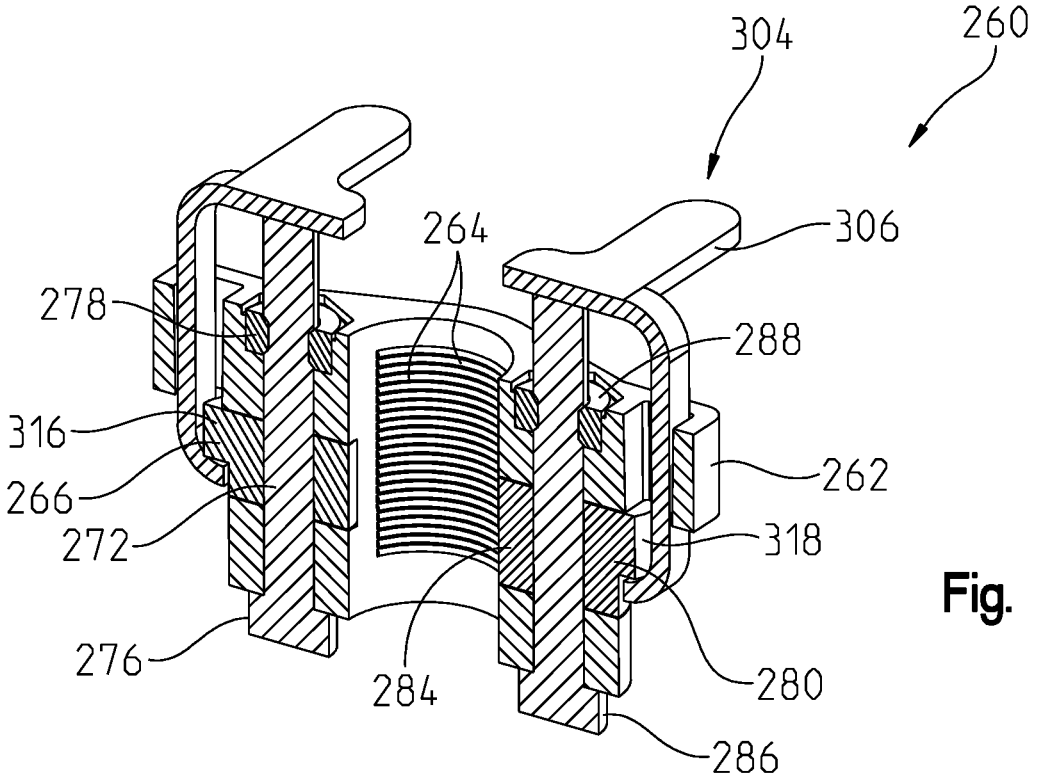
FIG. 18 is another perspective view, in cross-section, of the faucet mounting system of FIG. 15 with the bracket shown in a raised position.

With reference to FIGS. 16-18, a first end of the clamping member 266 is coupled to the body 262 by a pivot joint 272, illustratively defined by a bolt 276 and a cooperating nut 278. A connecting arm 280 includes a first end coupled to the body 262 by a pivot joint 284, illustratively defined by a bolt 286 and a cooperating nut 288. A lever 290 is pivotably supported by the body 262, and is positioned intermediate the clamping member 266 and the connecting arm 280. The lever 290 illustratively includes a body 292 including a pull member 294. More particularly, first pivot pins 296 couple a second end of the clamping member 266 to the lever 290. A second pivot pin 300 couples the lever 290 to a second end of the connecting arm 280.

In certain illustrative embodiments, a mounting bracket 304 is operably coupled to the body 262. More particularly, the mounting bracket 304 includes a bracket plate 306 and downwardly extending arms 308 and 310. The arms 308 and 310 are slidably received within openings 312 and 314, respectively, of the body 262. The bolts 276 and 286 illustratively define jack screws threadably supported by the nuts 278 and 288, respectively, supported within the body 262 for vertically moving the bracket plate 306 between a lowered position (FIG. 17) and a raised position (FIG. 18). Protrusions or lugs 316 and 318 are illustratively supported by the clamping member 266 and the connecting arm 280, respectively, and are configured to retain the arms 308 and 310 of the bracket plate 306.

Figure 19:
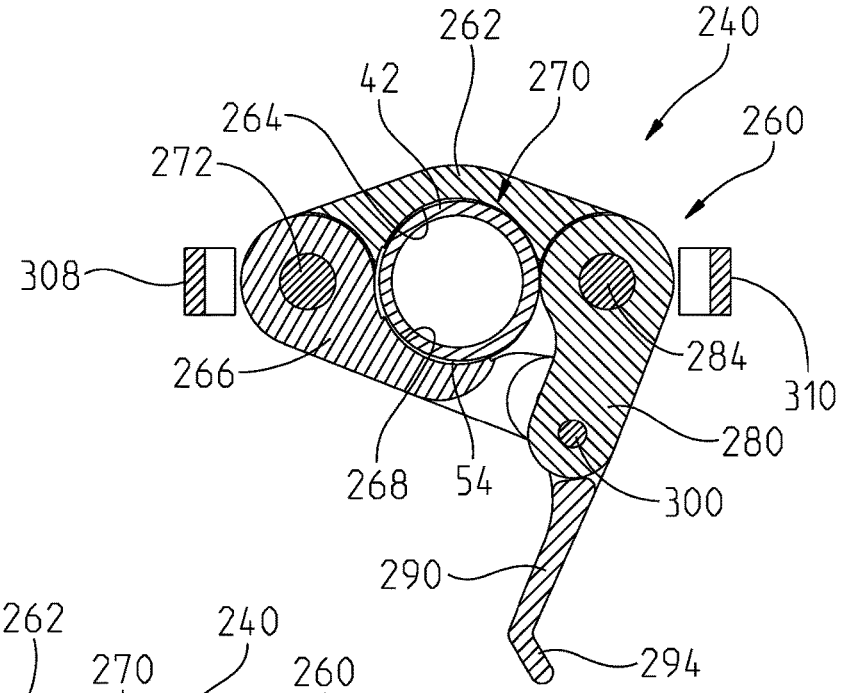
FIG. 19 is a cross-sectional view of the faucet mounting system taken along line 19-19 of FIG. 15, shown in an unlocked position.
Figure 20:
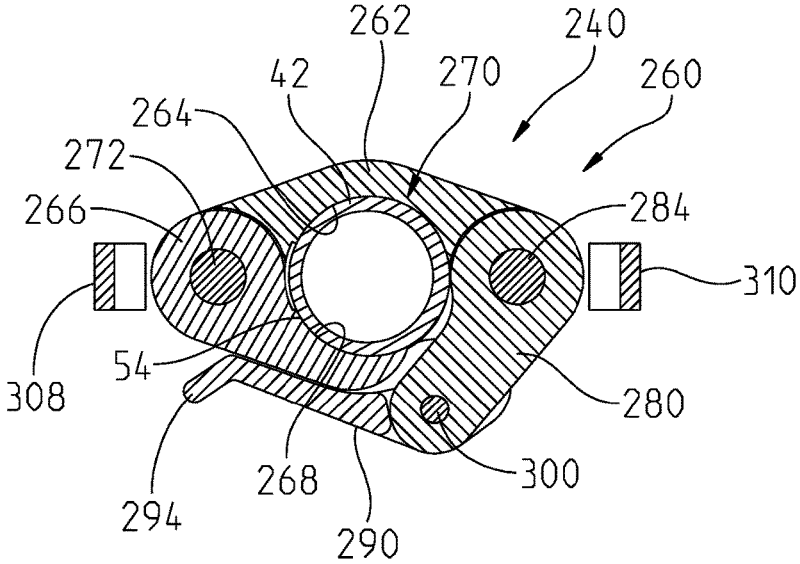
FIG. 20 is a cross-sectional view of the faucet mounting system of FIG. 15 taken along line 19-19 of FIG. 15, shown in a locked position.
Figure 21:
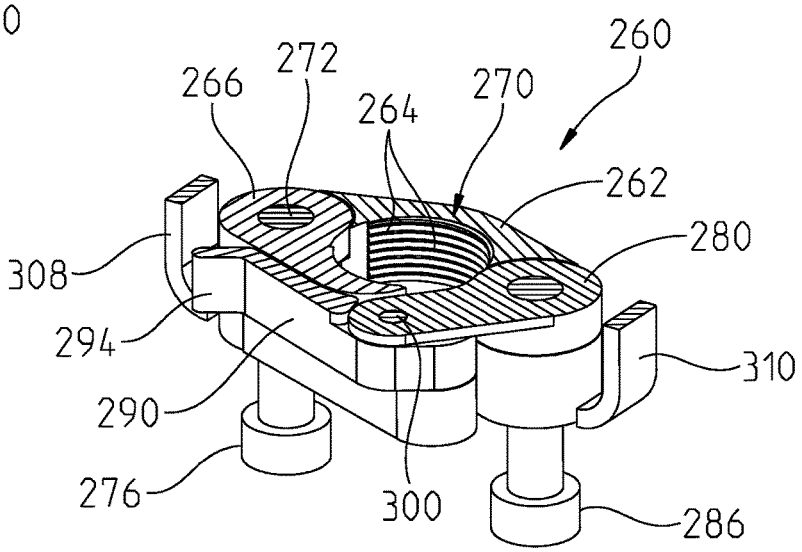
FIG. 21 is a perspective view of the faucet mounting system, in cross-section taken along line 19-19, of FIG. 15.

With reference now to FIGS. 19-21, pivoting movement of the lever 290 pivots the clamping member 266 between an outward or unlocked position (FIG. 19) and an inward or locked position (FIGS. 20 and 21). A pull member 294 of the lever 290 is illustratively supported by the body 262. In the inward or locked position of the clamping member 266, the internal threads 264 and 268 are in locking engagement with the external threads 54 of the mounting shank 42. In the outward or unlocked position of the clamping member 266, the internal threads 264 and 268 are in spaced relation to the external threads 54 of the mounting shank 42, such that the mounting shank 42 may be moved relative thereto.

The quick mount nut 260 utilizes the mechanical advantage of the lever 290, which can constrict the split ring 270, and the friction of the split ring 270, which holds the mounting nut 260 in place on the mounting shank 42 when the lever 290 is in the locked position. The body 262, the clamping member 266, the connecting arm 280 and the lever 290 together define a four bar linkage to move the split ring 270. The split ring 270 is large enough to slide up and down the mounting shank 42 when the lever 290 is in the unlocked position. Pulling the pull member 294 of the lever 290 constricts the split ring 270, thereby locking the mounting nut 260 in place on the mounting shank 42. The lever 290 stays in place after locking due to mechanical advantage.

With reference now to FIGS. 22-28, a further illustrative mounting system 440 is shown as including a securement device 460, illustratively a cam mounting nut. In the following description and related drawing figures, similar components of the mounting system 40 and the mounting system 440 are identified with like reference numbers.

The illustrative securement device 460 includes a body 462 including first internal threads 464, and a locking block 466 supported for sliding movement by the body 462. The locking block 466 includes second internal threads 468 facing inwardly toward the first internal threads 464. A cam 470 is pivotably supported by the body 462 and includes an arcuate or cam surface 472 to engage an outwardly facing engagement surface 474 of the locking block 466 to move the second internal threads 468 inwardly towards the first internal threads 464 due to pivoting movement of the cam 470.

Figure 22:
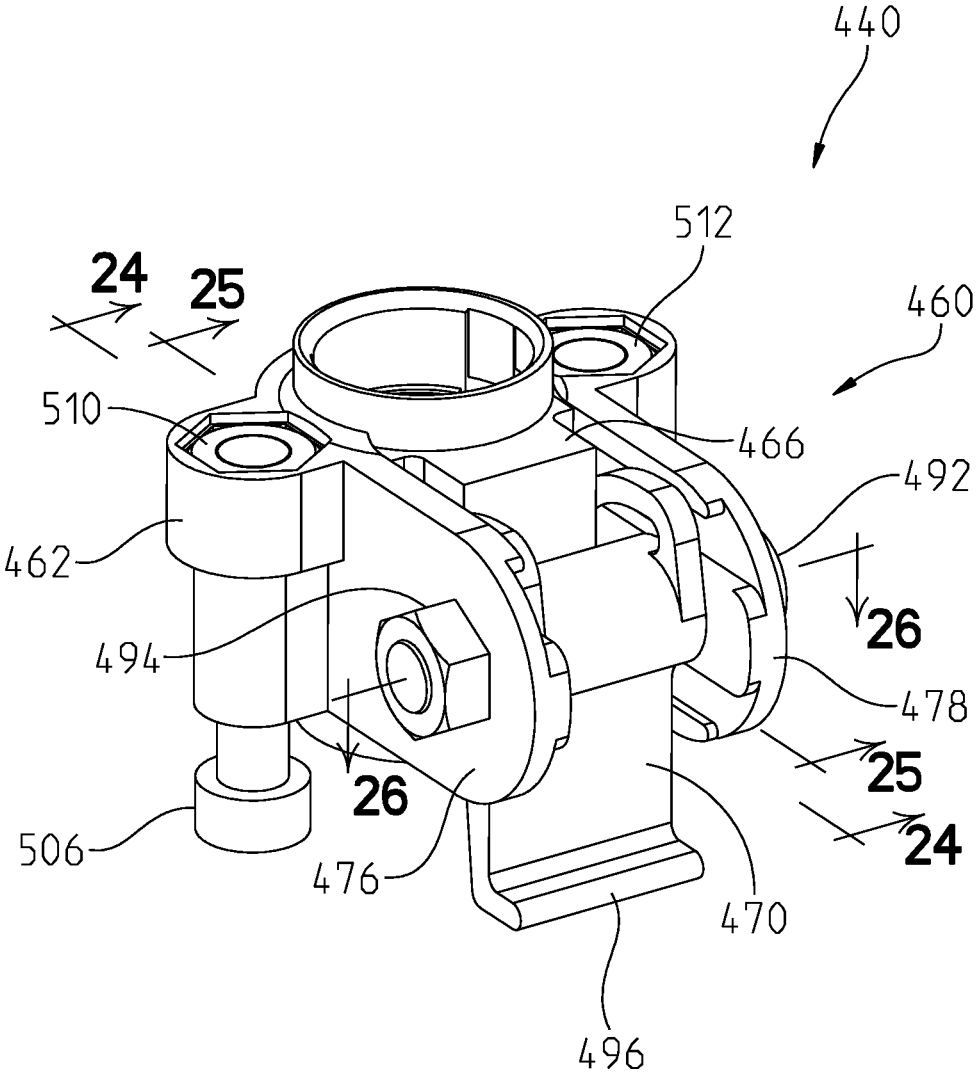
FIG. 22 is a perspective view of another illustrative embodiment faucet mounting system of the present disclosure.
Figure 23:
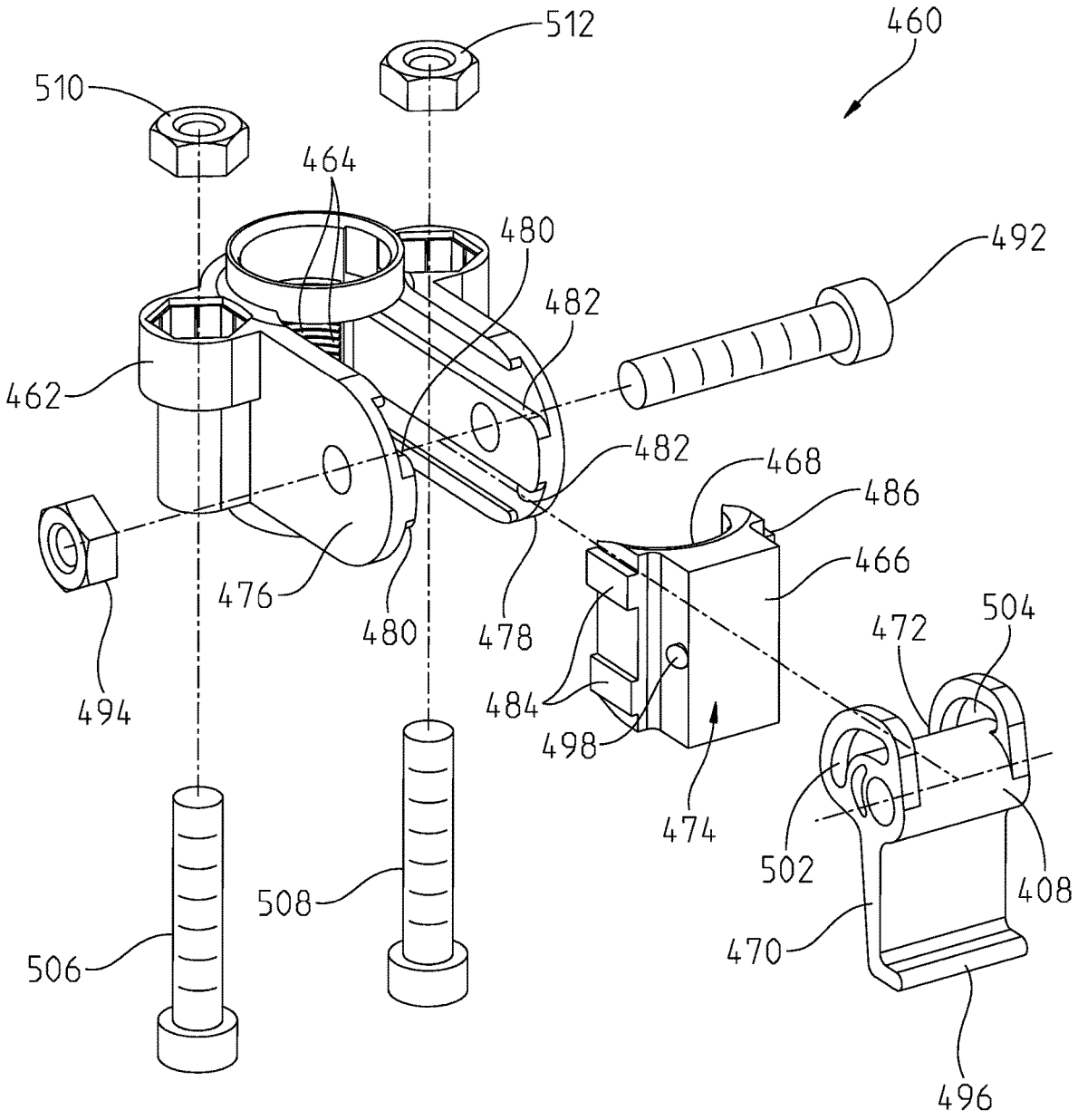
FIG. 23 is an exploded perspective view of the faucet mounting system of FIG. 22.
Figure 24:
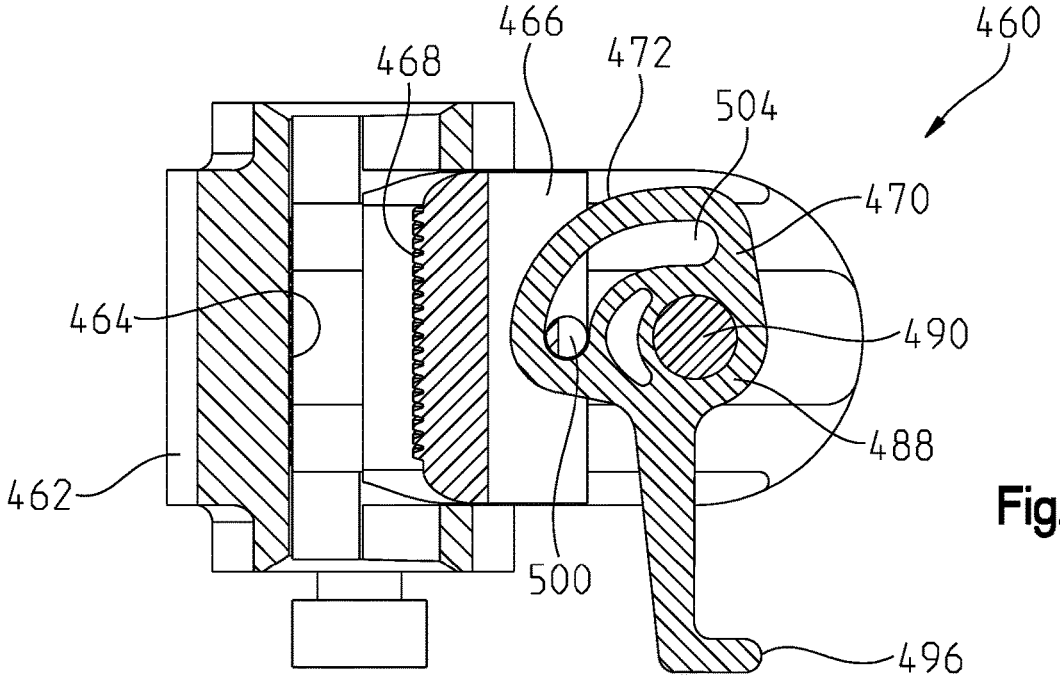
FIG. 24 is a cross-sectional view of the faucet mounting system taken along line 24-24 of FIG. 22, shown in a locked position.
Figure 25:
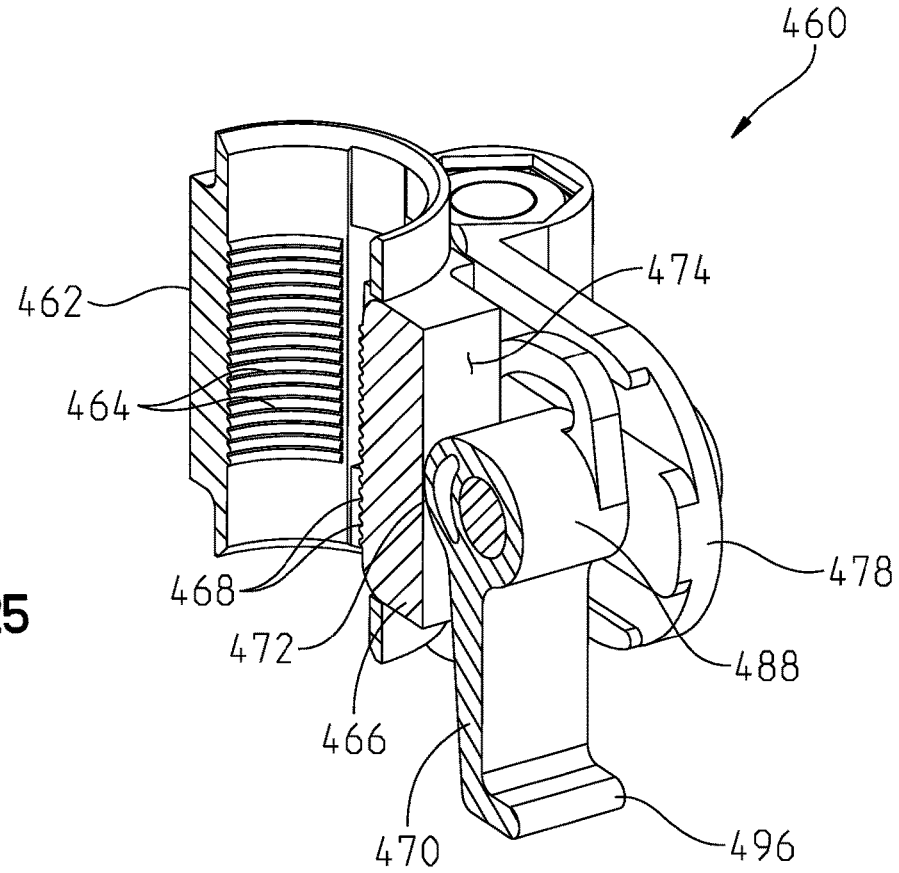
FIG. 25 is a perspective view, in cross-section taken along line 25-25, of the faucet mounting system of FIG. 22, shown in the locked position.
Figure 26:
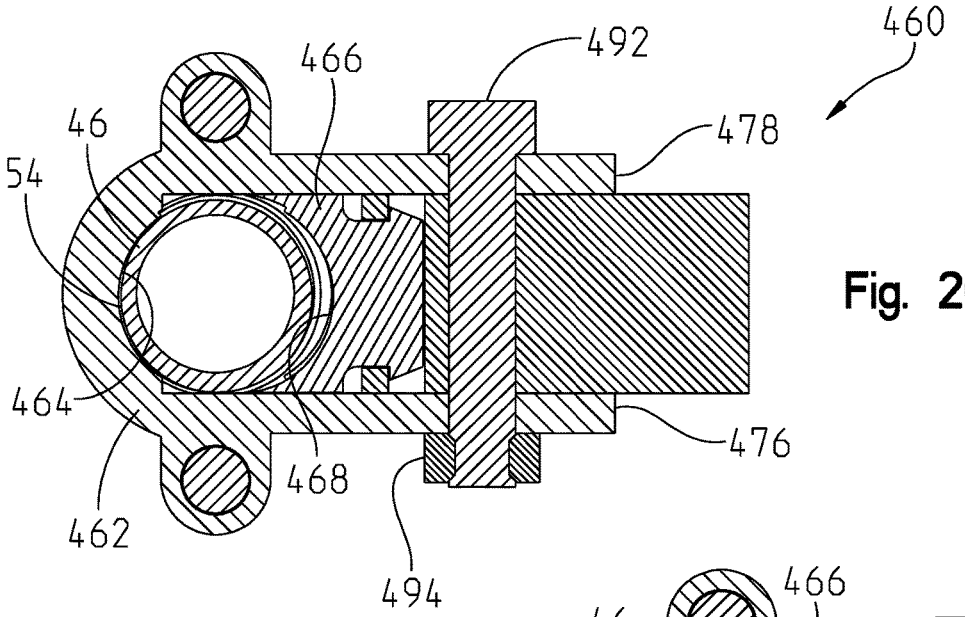
FIG. 26 is a cross-sectional view of the faucet mounting system taken along line 26-26 of FIG. 22, shown in an unlocked position.
Figure 27:
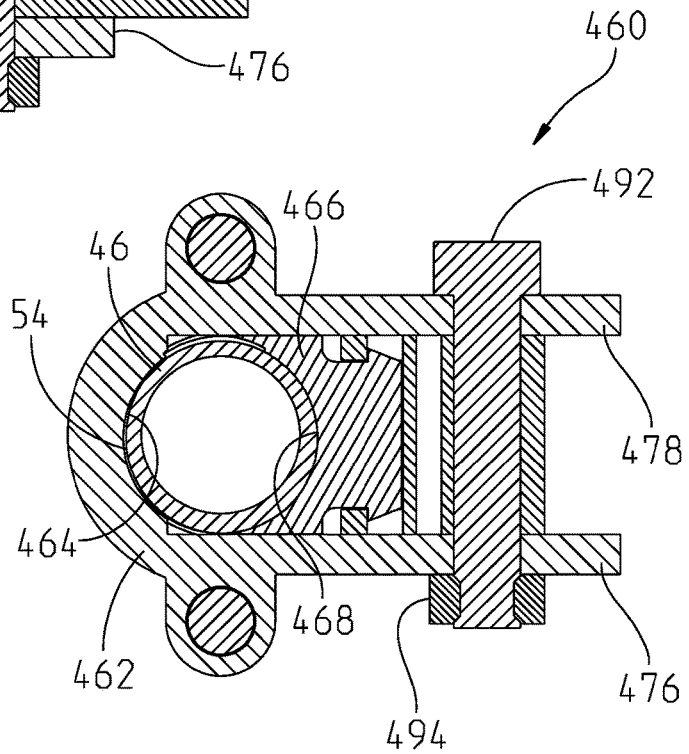
FIG. 27 is a cross-sectional view of the faucet mounting system taken along line 26-26 of FIG. 22, shown in the locked position.
Figure 28:
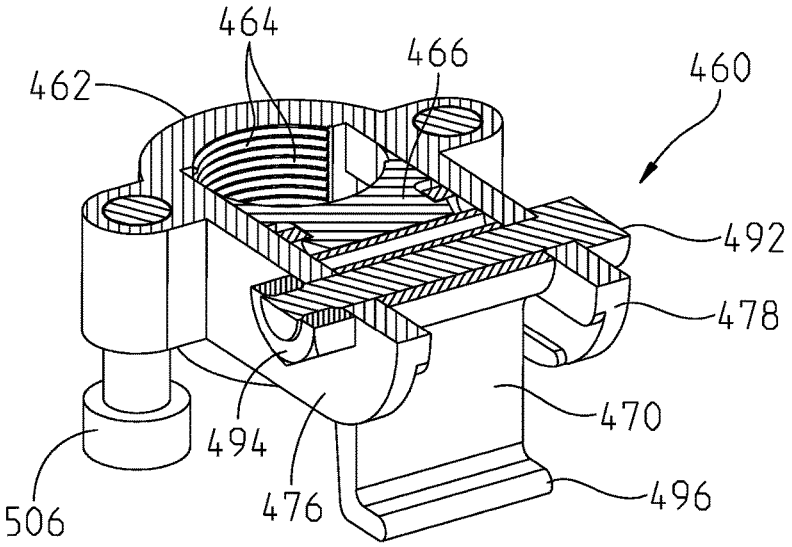
FIG. 28 is a perspective view, in cross-section taken along line 26-26, of the faucet mounting system of FIG. 22, shown in the locked position.

With reference to FIGS. 22 and 23, the illustrative body 462 includes a pair of opposing arms 476 and 478 including inwardly facing slots or tracks 480 and 482. The locking block 466 includes outwardly facing protrusions 484 and 486 slidably received within the tracks 480 and 482 of the body 462. The cam 470 includes a cam body 488 defining the arcuate surface 472. The cam body 488 is supported by a pivot joint 490, illustratively defined by a bolt 492 and a cooperating nut 494. More particularly, the bolt 492 is operably coupled to the opposing arms 476 and 478 of the body 462. The cam body 488 includes a lever 496 extending radially outwardly from the pivot joint 490 to facilitate pivoting movement of the arcuate surface 472.

With reference to FIGS. 24-28 and as further detailed herein, pivoting movement of the cam 470 in a first direction (illustratively clockwise) resulting in engagement of the arcuate surface 472 of the cam 470 with the engagement surface 474 of the locking block 466 causes the second internal threads 468 to move inwardly toward the first internal threads 464. Opposing angled pins 498 and 500 are supported by the locking block 466 and received within arcuate slots 502 and 504, respectively, supported by the cam body 488. As further detailed herein, pivoting movement of the cam 470 in a second direction causes the slots 502 and 504 to pull the locking block 466 outwardly such that the second internal threads 468 move outwardly away from the first internal threads 464.

In certain illustrative embodiments, a mounting bracket such as a bracket plate or washer (not shown) may be slidably supported on the mounting shank 42 intermediate the securement device 460 and the mounting deck 12. A pair of jack screws 506 and 508 and cooperating nuts 510 and 512 may be threadably supported within the body 462 for vertically moving the bracket plate.

The securement device 460 includes the body 462, the cam 470 with lever 476, and the locking block 466. The body 462 holds the parts of the mounting nut 460 together and includes slots 480 and 482 on which the locking block 466 can slide and into which the bolt 492 can be inserted and about which the cam 470 can rotate. The body 462 includes recesses 514 and 516 to hold two separate nuts 510 and 512 in place. The nuts 510 and 512 are for use with the jack screws 506 and 508, which are employed in the final tightening of the mounting nut 460.

The interrupted threads 464 and 468 are aligned to match up with the external threads 54 of the mounting shank 42. Cross threading may be prevented by collars or rings 518 and 520 on the top and bottom of the body 462, which prevents angular misalignment of the threads 464, 468 and 54. The protrusions 484 and 486 on the locking block 466 engaging with the slots 480 and 482 on the body 462 prevent rotation locking block 466 with respect to the body 462. As noted above, angled pin protrusions 498 and 500 are present on each side of the locking block 466, which engage with slots 502 and 504 on the cam 470. This enables the cam 470 to control the rearward motion of the locking block 466 during disengagement with the mounting nut 460. The forward motion of the locking block 466 is controlled by the main cam 472 surface of the cam 470 during locking engagement of the mounting nut 460.

Installation of the mounting nut 460 occurs by disengaging the rotating the cam lever 496 to the horizontal position. Then, the mounting nut 460 is slid along the mounting shank 42 until it is upwardly positioned under the sink deck 12. When the cam lever 496 has been rotated down to the vertical position, the mounting nut 460 is now locked onto the mounting shank 42. Next, the jack screws 506 and 508 are tightened, thereby securing the faucet 10 to the mounting deck 12. Removal of the mounting nut 460 can quickly be achieved by lifting up on the cam lever 496 and sliding the nut 460 down on the mounting shank 42.

Although the invention has been described in detail with reference to certain preferred embodiments, variations and modifications exist within the spirit and scope of the invention as described and defined in the following claims.

The invention claimed is:

1. A faucet mounting system comprising:

a mounting shank including external threads; and a securement device including:

an upper housing having an inner surface, an insert received within the upper housing, the insert including a body, an inner surface defining a passageway extending between a lower end and an upper end, an outer surface, internal threads extending into the passageway, wherein at least one of the inner surface of the upper housing and the outer surface of the insert is tapered;

wherein engagement of the inner surface of the upper housing and the outer surface of the insert forces the internal threads inwardly toward the external threads of the mounting shank, and a lower housing having an engagement surface received within the lower end of the passageway of the insert, wherein engagement of the engagement surface of the lower housing and the inner surface of the insert forces the internal threads outwardly away from the external threads of the mounting shank.

2. The faucet mounting system of claim 1, wherein the inner surface of the upper housing is tapered.

3. The faucet mounting system of claim 1, wherein the engagement surface of the lower housing is tapered.

4. The faucet mounting system of claim 1, wherein the upper housing includes an annular groove, and the lower housing includes a protrusion received within the annular groove to couple together the upper housing and the lower housing.

5. The faucet mounting system of claim 1, wherein the body of the insert is flexible.

6. The faucet mounting system of claim 5, wherein the body of the flexible insert is formed of a polymer.

7. The faucet mounting system of claim 5, wherein the flexible body of the insert includes a plurality of circumferentially spaced recesses, and a gap between opposing ends.

8. The faucet mounting system of claim 1, wherein the body of the insert extends circumferentially between a first end and a second end, and a gap is defined between the first end and the second end.

9. The faucet mounting system of claim 8, wherein the lower housing includes an upwardly extending protrusion received within the gap of the insert to transmit rotation of the lower housing to the insert.

10. The faucet mounting system of claim 2, wherein:

the tapered inner surface of the upper housing is frusto-conical; and the outer surface of the flexible insert is frusto-conical.

11. The faucet mounting system of claim 1, wherein:

a first mode is defined when the internal threads of the insert threadably engage with the external threads of the mounting shank;

a second mode is defined when the inner surface of the upper housing forces the outer surface of the insert inwardly such that the internal threads are in locking engagement with the external threads of the mounting shank; and a third mode is defined when the engagement surface of the lower housing forces the inner surface of the insert outwardly such that the internal threads move away from the external threads of the mounting shank.

12. The faucet mounting system of claim 1, wherein the securement device includes a torque limiter configured to limit the torque applied to the lower housing.

13. The faucet mounting system of claim 12, wherein torque limiter includes a plurality of first teeth supported by the lower housing, and a torque limiting ring including a plurality of second teeth cooperating with the plurality of first teeth of the lower housing.

14. A mounting nut comprising:

an upper housing including an inner surface;

an insert received within the upper housing, the insert including a body, an inner surface defining a passageway extending between a lower end and an upper end, an outer surface, internal threads extending into the passageway;

wherein at least one of the inner surface of the upper housing and the outer surface of the insert is frusto-conical;

wherein engagement of the inner surface of the upper housing and the outer surface of the insert forces the internal threads inwardly; and a lower housing having a frusto-conical surface received within the lower end of the passageway of the body of the insert, wherein engagement of the frusto-conical surface of the lower housing and the inner surface of the insert forces the internal threads outwardly.

15. The mounting nut of claim 14, wherein the upper housing includes an annular groove, and the lower housing includes a protrusion received within the annular groove to couple together the upper housing and the lower housing.

16. The mounting nut of claim 14, wherein the body of the insert is flexible.

17. The mounting nut of claim 16, wherein the body of the flexible insert is formed of a polymer.

18. The mounting nut of claim 14, wherein the body of the flexible insert extends circumferentially between a first end and a second end, and a gap is defined between the first end and the second end.

19. The mounting nut of claim 18, wherein the lower housing includes an upwardly extending protrusion received within the gap of the flexible insert to transmit rotation of the lower housing to the flexible insert.

20. The mounting nut of claim 14, wherein the body of the flexible insert includes a plurality of circumferentially spaced recesses, and a gap between opposing ends.

21. The mounting nut of claim 14, further comprising a torque limiter configured to limit the torque applied to the lower housing.

22. The mounting nut of claim 21, wherein the torque limiter includes a plurality of first teeth supported by the lower housing, and a torque limiting ring including a plurality of second teeth cooperating with the plurality of first teeth of the lower housing.

* * * * *